US009655486B2

(12) United States Patent
Xu et al.

(10) Patent No.: US 9,655,486 B2
(45) **Date of Patent: *May 23, 2017**

(54) SURFACE CLEANING HEAD INCLUDING REMOVABLE ROTATABLE DRIVEN AGITATOR

(71) Applicant: SHARKNINJA OPERATING LLC, Newton, MA (US)

(72) Inventors: Kai Xu, Suzhou (CN); AiMing Xu, Suzhou (CN); Erin Burke, Boston, MA (US)

(73) Assignee: SharkNinja Operating LLC, Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/801,185

(22) Filed: Jul. 16, 2015

(65) Prior Publication Data

US 2016/0220081 A1 Aug. 4, 2016

Related U.S. Application Data

(63) Continuation-in-part of application No. 14/739,915, filed on Jun. 15, 2015, now Pat. No. 9,456,723.

(Continued)

(51) Int. Cl.

*A47L 9/04* (2006.01)
*A47L 9/06* (2006.01)

(Continued)

(52) U.S. Cl.

CPC ..... *A47L 9/0477* (2013.01); *A47L 5/30* (2013.01); *A47L 9/02* (2013.01); *A47L 9/04* (2013.01);

(Continued)

(58) Field of Classification Search

CPC ..... A47L 9/04; A47L 9/0405; A47L 9/0411; A47L 9/0455; A47L 9/0477; A47L 9/0444; A47L 5/30

(Continued)

(56) References Cited

U.S. PATENT DOCUMENTS 2,411,488 A 11/1946 White
2,785,431 A 3/1957 Pardee (Continued)

FOREIGN PATENT DOCUMENTS

DE 102012207357 A1 * 7/2013 ..... A47L 9/04
EP 0909547 A2 4/1999

(Continued)

OTHER PUBLICATIONS

PCT International Search Report and Written Opinion mailed Mar. 31, 2016, received in corresponding PCT Application No. PCT/US16/15370, 15 pgs.

*Primary Examiner* — Bryan R Muller
(74) *Attorney, Agent, or Firm* — Grossman Tucker Perreault & Pfleger, PLLC

(57) ABSTRACT

A surface cleaning head includes a removable rotatable driven agitator, such as a brush roll, which is driven by a drive mechanism that axially engages the driven end. The removable rotatable driven agitator may be located in an openable agitator chamber for purposes of removing debris and/or removing the agitator. The openable agitator chamber may be covered by an external cover that is movable between an open position and a closed position. The removable agitator may be secured in the agitator chamber by the external cover. Different removable agitators with different characteristics may be used interchangeably in the surface cleaning head. The surface cleaning head may also include (Continued)

one or more transparent regions (e.g., on the openable cover) to allow visual inspection of the agitator during use.

36 Claims, 15 Drawing Sheets

Related U.S. Application Data

(60) Provisional application No. 62/110,232, filed on Jan. 30, 2015.

(51) Int. Cl.
*A47L 5/10* (2006.01)
*A47L 5/26* (2006.01)
*A47L 5/30* (2006.01)
*A47L 9/02* (2006.01)

(52) U.S. Cl.
CPC ..... *A47L 9/0444* (2013.01); *A47L 9/0455* (2013.01); *A47L 9/0405* (2013.01); *A47L 9/0411* (2013.01)

(58) Field of Classification Search
USPC ..... 15/392, 383, 389, 393, 363, 366, 377
See application file for complete search history.

(56) References Cited

U.S. PATENT DOCUMENTS 2,910,721 A * 11/1959 Burrage ..... A47L 5/10 15/342
3,643,276 A * 2/1972 Worwag ..... A47L 11/4069 15/52.1
4,173,807 A 11/1979 Maier
4,333,205 A 6/1982 Woodward et al.
4,372,004 A 2/1983 Vermillion
4,662,027 A 5/1987 Parker et al.
4,866,804 A * 9/1989 Masbruch ..... A47L 11/164 15/49.1
5,014,387 A * 5/1991 Hays ..... A47L 9/0494 15/339
5,309,601 A * 5/1994 Hampton ..... A47L 5/30 15/339
5,452,490 A 9/1995 Brundula et al.
5,495,634 A 3/1996 Brundula et al.
5,632,060 A 5/1997 Steinberg et al.
5,659,919 A * 8/1997 Kajihara ..... A47L 9/00 15/325
5,765,258 A 6/1998 Melito et al.
5,960,514 A * 10/1999 Miller ..... A47L 9/0422 15/27
6,012,200 A 1/2000 Murphy et al.
6,226,832 B1 * 5/2001 McCormick ..... A47L 5/30 15/389
6,324,714 B1 * 12/2001 Walz ..... A46B 13/001 15/392
6,513,190 B1 * 2/2003 Allgeier ..... A47L 9/0416 15/383
6,550,099 B2 4/2003 Worwag
7,013,528 B2 3/2006 Parker et al.
7,200,893 B2 4/2007 Gerber et al.
7,316,050 B2 1/2008 Worwag
7,329,294 B2 2/2008 Conrad
7,690,079 B2 4/2010 Boddy et al.
7,987,546 B2 * 8/2011 Poch ..... A47L 11/24 15/179
8,037,571 B2 10/2011 Butts et al.
8,316,503 B2 11/2012 Follows et al.
8,402,601 B2 3/2013 Fahlstrom
8,434,194 B2 * 5/2013 Jeong ..... A47L 5/28 15/383
8,631,541 B2 1/2014 Tran
8,726,441 B1 5/2014 Colasanti et al.
8,776,311 B2 7/2014 Genn et al.
8,782,851 B2 7/2014 Follows et al.
8,800,107 B2 8/2014 Blouin
8,806,710 B2 8/2014 Follows et al.
2003/0145424 A1 8/2003 Stephens et al.
2003/0159240 A1 8/2003 Mertes et al.
2004/0045125 A1 3/2004 Park et al.
2010/0306958 A1 12/2010 Follows et al.
2011/0296648 A1 12/2011 Kah, Jr.
2012/0311802 A1 12/2012 Hinnant
2013/0212831 A1 8/2013 Follows et al.

FOREIGN PATENT DOCUMENTS

GB 583738 12/1946
GB 2509925 B 7/2014
JP H10201682 A 8/1998
JP 2009045503 A 3/2009
JP 2011050428 A 3/2011
WO 0141618 A1 6/2001
WO 2013104886 A1 7/2013
WO 2014131105 A1 9/2014
WO 2014131106 A1 9/2014

* cited by examiner

SURFACE CLEANING HEAD INCLUDING REMOVABLE ROTATABLE DRIVEN AGITATOR

CROSS-REFERENCE TO RELATED APPLICATIONS

This application claims the benefit of U.S. Provisional Patent Application Ser. No. 62/110,232, filed on Jan. 30, 2015, which is fully incorporated herein by reference. This application is also a continuation-in-part of U.S. patent application Ser. No. 14/739,915 filed on Jun. 15, 2015, which is fully incorporated herein by reference.

TECHNICAL FIELD

The present invention relates to vacuum cleaners and more particularly, to a vacuum cleaner surface cleaning head with removable rotatable agitators.

BACKGROUND INFORMATION

The following is not an admission that anything discussed below is part of the prior art or part of the common general knowledge of a person skilled in the art.

A surface cleaning apparatus, more commonly known as a vacuum cleaner, may be used to clean a variety of surfaces using at least suction. Various types of vacuum cleaners are known including, without limitation, upright vacuum cleaners, canister vacuum cleaners, stick vacuum cleaners and central vacuum systems. A surface cleaning apparatus typically includes a surface cleaning head with an inlet. Some vacuum cleaners include some or all of the operating components (e.g., the suction motor and the air treatment members) at a location other than the surface cleaning head to enable the surface cleaning head to be lighter or smaller. An upright vacuum cleaner, for example, may include an upright section containing at least an air treatment member that is mounted to a surface cleaning head. A canister vacuum cleaner may include a canister body containing at least an air treatment member and a suction motor that is connected to a surface cleaning head by a flexible hose and a handle. Another type of vacuum cleaner includes the suction motor and the air treatment members (e.g., one or more cyclones) positioned in the surface cleaning head.

A surface cleaning apparatus, such as any of the vacuum cleaners mentioned above, may also include one or more mechanical agitators, such as a rotating brush roll, in the surface cleaning head to facilitate cleaning a surface. One problem with mechanical agitators, particularly rotating brush rolls, is the difficulty removing debris (e.g., hair) that becomes entangled. The surface cleaning head often must be turned upside down to determine if the agitator is entangled or clogged and to remove the debris. Removing the debris from the mechanical agitator located inside the surface cleaning head may also be difficult, especially through the limited opening in the bottom of the surface cleaning head. An inability to remove the debris adequately may result in a decrease in performance and even damage to the mechanical agitator and/or vacuum cleaner.

In some conventional vacuum cleaners, the agitator also may not be suitable for all surfaces and/or conditions. A rotating brush roll, for example, may be desirable to provide agitation on a carpet but not on a hard wood floor. This may further limit the performance as well as the versatility of the vacuum cleaner.

SUMMARY

Consistent with an embodiment, a surface cleaning head is provided for a vacuum. The surface cleaning head includes a cleaning head housing having a front end portion, a rear end portion, laterally disposed sides, an upper portion and a bottom portion. An agitator chamber is located in the front end portion of the cleaning head housing and has a top opening through the upper portion of the cleaning head housing and a bottom opening through the bottom portion of the cleaning head housing. The agitator chamber includes a non-driven side and a driven side. The surface cleaning head also includes an agitator drive mechanism including a drive member at the driven side of the agitator chamber and an agitator drive motor drivingly coupled to the drive member. An external cover is mounted to the cleaning head housing for covering the top opening of the agitator chamber and is movable between a closed position and an open position such that the agitator chamber is covered when the external cover is in the closed position and accessible through the top opening when the external cover is in the open position. A rotatable driven agitator is removably mounted within the agitator chamber such that the agitator is configured to contact a surface through the bottom opening and is accessible and removable through the top opening when the external cover is in the open position. The rotatable driven agitator includes a non-driven end mounted at the non-driven side of the agitator chamber such that the agitator spins freely at the non-driven end and a driven end including a driven member. The driven member mates axially and engages with the drive member of the drive mechanism such that the drive member transmits torque and rotation to the driven member and the rotatable driven agitator.

Consistent with another embodiment, a surface cleaning head is provided for a vacuum. The surface cleaning head includes a cleaning head housing having a front end portion, a rear end portion, laterally disposed sides, an upper portion and a bottom portion. An agitator chamber is located in the front end portion of the cleaning head housing and has a top opening through the upper portion of the cleaning head housing and a bottom opening through the bottom portion of the cleaning head housing. An external cover is mounted to the cleaning head housing for covering the top opening of the agitator chamber. The external cover is movable between a closed position and an open position such that the agitator chamber is covered when the external cover is in the closed position and accessible through the top opening when the external cover is in the open position. At least first and second rotatable driven agitators are configured to be removably mounted within the agitator chamber and removable through the top opening when the external cover is in the open position such that the rotatable driven agitators are interchangeable. The first rotatable driven agitator has different agitating characteristics than the second rotatable driven agitator.

Consistent with a further embodiment, a surface cleaning head is provided for a vacuum. The surface cleaning head includes a cleaning head housing having a front end portion, a rear end portion, laterally disposed sides, an upper portion and a bottom portion. An agitator chamber is located in the front end portion of the cleaning head housing and has a top opening through the upper portion of the cleaning head housing and a bottom opening through the bottom portion of the cleaning head housing. The agitator chamber is configured to receive a rotatable driven agitator such that the agitator contacts a surface through the bottom opening and is removable through the top opening. The agitator chamber includes a non-driven side for receiving a non-driven end of the rotatable driven agitator and a driven side for receiving a driven end of the rotatable driven agitator. The surface cleaning head also includes an agitator drive mechanism including a drive member at a driven side of the agitator chamber and an agitator drive motor drivingly coupled to the drive member. The drive member is configured to mate axially and engage with the driven member on the rotatable driven agitator such that the drive member transmits torque and rotation to the driven member and the rotatable driven agitator. An external cover is mounted to the cleaning head housing for covering the top opening of the agitator chamber. The external cover is movable between a closed position and an open position such that the agitator chamber is covered when the external cover is in the closed position and accessible through the top opening when the external cover is in the open position.

BRIEF DESCRIPTION OF THE DRAWINGS

These and other features and advantages will be better understood by reading the following detailed description, taken together with the drawings wherein.

Figure 1:
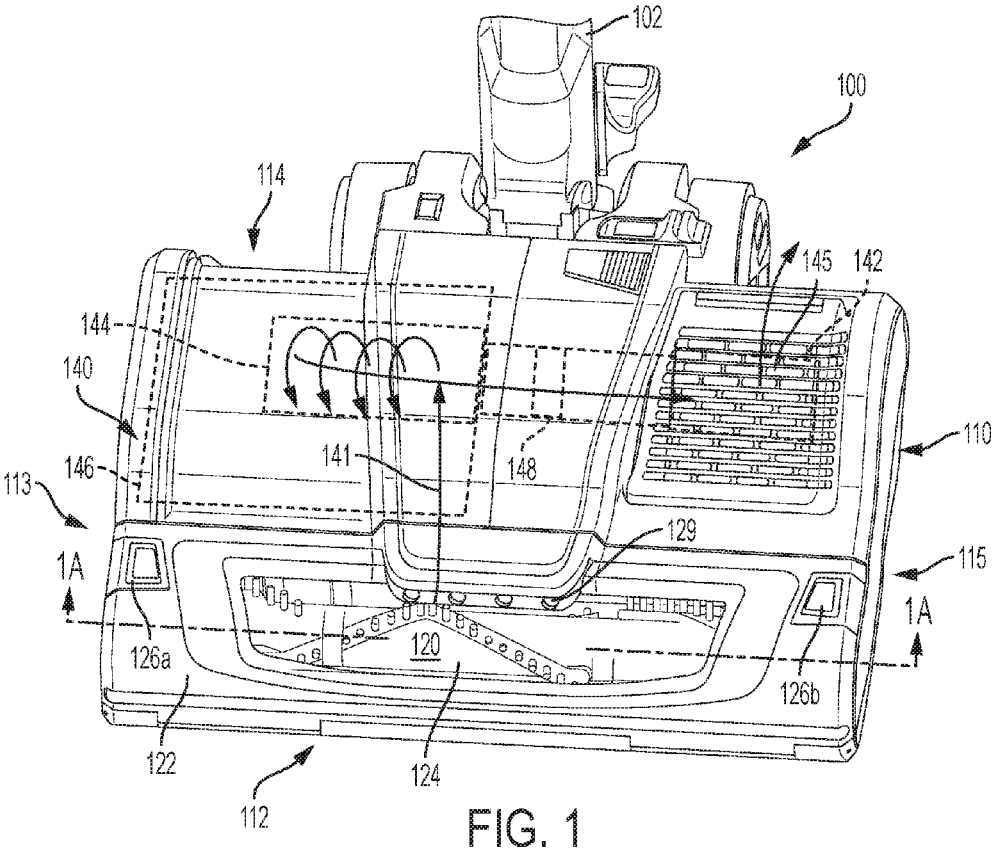
FIG. 1 is a perspective view of a surface cleaning head including an openable agitator chamber covered by an external cover with a transparent region, consistent with an embodiment of the present disclosure.

The drawings included herewith are for illustrating various examples of articles, methods, and apparatuses of the teaching of the present specification and are not intended to limit the scope of what is taught in any way.

DETAILED DESCRIPTION

A surface cleaning head, consistent with embodiments of the present disclosure, includes a removable rotatable driven agitator, such as a brush roll, which is driven by a drive mechanism that axially engages the driven end. The removable rotatable driven agitator may be located in an openable agitator chamber for purposes of removing debris and/or removing the agitator. The openable agitator chamber may be covered by an external cover that is movable between an open position and a closed position. The removable agitator may be secured in the agitator chamber by the external cover. Different removable agitators with different characteristics may be used interchangeably in the surface cleaning head. The surface cleaning head may also include one or more transparent regions (e.g., on the openable cover) to allow visual inspection of the agitator during use.

In the illustrated embodiments, the openable agitator chamber, external cover, removable rotatable agitator and other features described herein are used in an "all in the head" type vacuum cleaner in which the functional or operational components for the transport and treatment of fluid (e.g., air) are substantially all contained within the surface cleaning head. The openable agitator chamber, external cover, removable rotatable agitator and other features described herein may also be implemented, within the scope of the present disclosure, in a surface cleaning head for any type of surface cleaning apparatus or vacuum including, without limitation, upright vacuum cleaners, canister vacuum cleaners, stick vacuum cleaners, robotic vacuum cleaners and central vacuum systems.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "agitator" refers to any element, member or structure capable of agitating a surface to facilitate movement of debris into a suction air flow in a surface cleaning head. As used herein, "transparent" means capable of allowing enough light to pass through so that objects on the other side can be seen.

Referring to FIGS. 1-3A, an embodiment of a surface cleaning head 100 is shown and described in greater detail. As shown in greater detail in FIG. 2, a wand 102 is steeringly coupled by a swivel connection to the surface cleaning head 100 and includes a handle 104 at one end to allow the user to control the surface cleaning head 100 during use. The wand 102 may have a telescoping configuration to provide length adjustment. The handle 104 may include controls 106 (e.g., a switch and/or speed control) for controlling operation of the surface cleaning head 100. In other embodiments, a surface cleaning head 100 may be provided without a wand and handle (e.g., in a robotic vacuum surface cleaning head or in a motorized attachment surface cleaning head).

The surface cleaning head 100 includes a cleaning head housing 110, an agitator chamber 120 located in the housing 110, and a rotatable agitator 130 located in the agitator chamber 120. The rotatable agitator 130 rotates about a rotation axis 2 (FIGS. 1A and 3) that may be generally orthogonal to the direction of travel 4 of the surface cleaning head 100. In the illustrated embodiment, the agitator chamber 120 is openable to provide access to the agitator 130. Providing access to the agitator 130 within the agitator chamber 120 may allow a user to inspect and/or clean the agitator 130 without having to remove the agitator and without having to touch a dirty agitator. The rotatable agitator 130 may also be removable from the agitator chamber 120 for inspection, cleaning and/or replacement. In other embodiments, the openable agitator chamber 120 may include a fixed agitator that is not removable, a non-rotatable agitator or any type of cleaning member.

The cleaning head housing 110 may generally include one or more pieces that enclose or encompass components of the surface cleaning head 100. In the illustrated embodiment, the surface cleaning head 100 is used in an "all in the head" type vacuum cleaner. As such, the cleaning head housing 110 encloses or encompasses an air transportation and treatment system 140 (shown schematically in FIGS. 1 and 3). The air transportation and treatment system 140 includes, for example, a suction motor 142, a cyclone including a cyclone chamber 144 and a dirt collection chamber 146 external to the cyclone chamber 144, and one or more filters 148. An air flow path 141 extends from a dirty air inlet 143 located in the agitator chamber 120 to a clean air outlet 145. The suction motor 142 causes air to be drawn into the dirty air inlet 143, through the cyclone chamber 144, and out the clean air outlet 145. As the dirt passes through the cyclone chamber 144, dirt is collected in the dirt collection chamber 146. Smaller particles may also be collected in the filter(s) 148. The air transportation and treatment system 140 may be similar to those used in existing or known "all in the head" type vacuum cleaners, for example, as disclosed in U.S. Pat. No. 7,329,294, which is incorporated herein by reference.

The cleaning head housing 110 includes a front end portion 112, a rear end portion 114, laterally disposed sides 113, 115, an upper portion 116, and a bottom portion 118. In the illustrated embodiment, the wand 102 is steeringly coupled to the rear end portion 114, and the agitator chamber 120 is located in the front end portion 112 and extends between a top opening 117 in the upper portion 116 and a bottom opening 119 in the bottom portion 118. The rotatable agitator 130 is located in the agitator chamber 120 and is configured to contact a surface to be cleaned through the bottom opening 119. The top opening 117 and the bottom opening 119 allow the rotatable agitator 130 to be accessed from either the top or bottom or the top and bottom simultaneously, which may help facilitate inspection or servicing of the agitator. For example, a user may clean the agitator 130 via the top opening 117 while allowing debris separated from the agitator 130 to fall out of the chamber via the bottom opening 119. The rotatable agitator 130 may also be removable from the agitator chamber 120, for example, through the top opening 117, as will be described in greater detail below.

Figure 3:
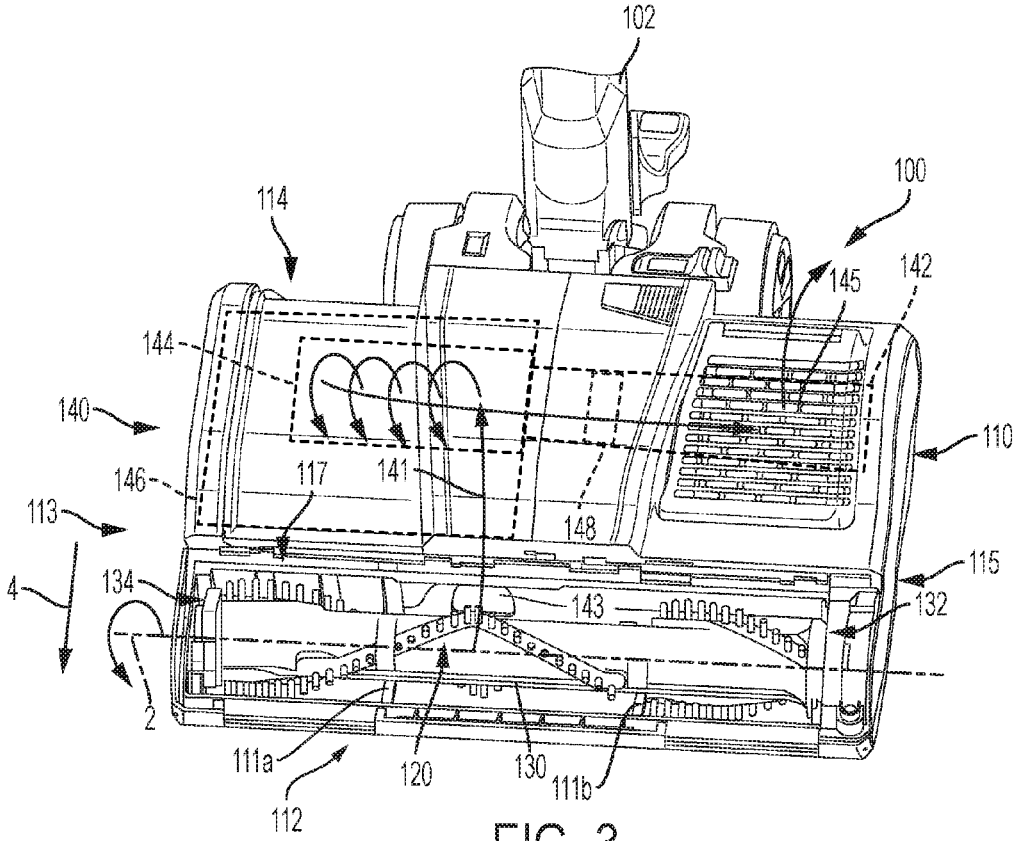
FIG. 3 is a perspective view of the surface cleaning head shown in FIG. 1 with an external cover removed to show a top opening into the agitator chamber.
Figure 3A:
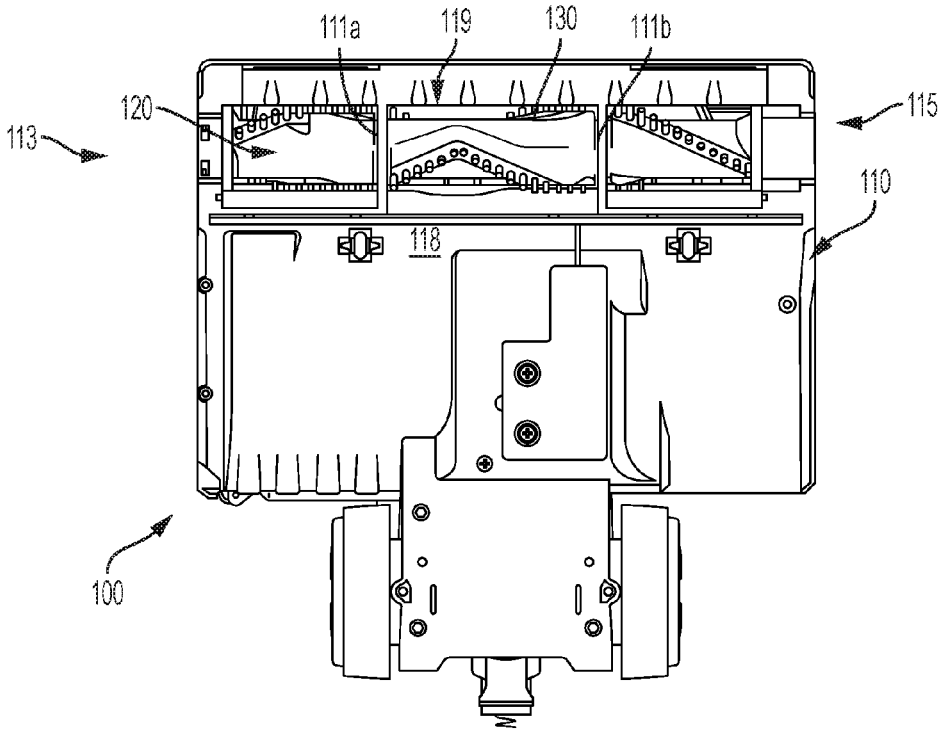
FIG. 3A is a bottom view of the surface cleaning head shown in FIG. 1 showing a bottom opening into the agitator chamber.

In the illustrated embodiment, the top opening 117 of the agitator chamber 120 has a width that is greater than a width of the agitator 130 to help provide access to the entire agitator 130 and/or to allow the rotatable agitator 130 to be removed. In other embodiments, the width of the top opening 117 of the agitator chamber 120 may be shorter. The bottom portion 118 includes one or more bottom guards or bars 111*a*, 111*b* extending across the bottom opening 119 (FIG. 3A).

In the illustrated embodiment, an external cover 122 is mounted to the upper portion 116 of the cleaning head housing 110 for covering the top opening 117 of the agitator chamber 120 (FIG. 1). The agitator chamber 120 may thus be opened while the surface cleaning head 100 is resting on the floor, thereby eliminating the need to pick up or reposition the surface cleaning head in order to access the agitator chamber 120. The external cover 122 is movable between a closed position (e.g., FIG. 1) and an open position (e.g., FIG. 3). In the closed position, the external cover 122 forms the top portion of the agitator chamber 120. The agitator chamber 120 and the agitator 130 may thus be easily accessed (e.g., without having to remove other walls or covers) simply by moving the external cover 122 to the open position. In the illustrated embodiment, the external cover 122 extends substantially the entire width of the surface cleaning head 100 but may also be shorter in other embodiments.

In the illustrated embodiment, the surface cleaning head 100 includes one or more transparent regions 124 that allow visual inspection of the agitator chamber 120. The transparent region 124 may be made out of a polycarbonate material. In this embodiment, the transparent region 124 is in the form of a window located on the external cover 122. Additionally or alternatively, one or more transparent regions may be located in other locations on the cleaning head housing 110 that allow visual inspection of the agitator 130 in the agitator chamber 120, for example, on the sides 113, 115. The transparent region 124 together with the movable external cover 122 thus facilitate a determination of debris in the agitator chamber 120 and/or agitator 130 and then removal of that debris.

The external cover 122 may be locked in the closed position using any suitable mechanism. In the illustrated embodiment, the external cover 122 includes one or more latch releases 126*a*, 126*b* for releasing respective latching mechanisms (not shown) that hold the external cover 122 into engagement with the cleaning head housing 110, as will be described in greater detail below. In the illustrated embodiment, the latch releases 126*a*, 126*b* are located proximate the respective sides 113, 115. Additionally or alternatively, one or more releasable latches may be provided in other locations on the external cover 122 and/or on the cleaning head housing 110. The external cover 122 may be pivotably or movably coupled to the cleaning head housing 110, as will be described in greater detail below, or may be completely removable from the cleaning head housing 110 (FIG. 3).

The surface cleaning head 100 may also include one or more lights, such as LEDs 129 on the external cover 122. In this embodiment, wiring (not shown) extends from the housing 110 to the external cover 122 and passes through the inside of the cover 122 to the LEDs 129. The lights may also be mounted on other locations on the cleaning head housing 110.

Figure 1A:
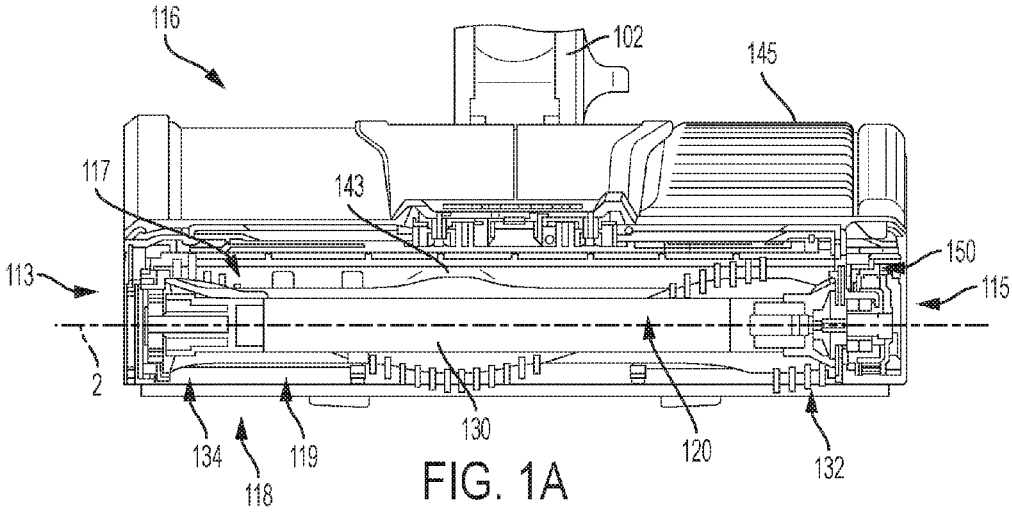
FIG. 1A is a cross-sectional view of the surface cleaning head shown in FIG. 1 taken along line 1A-1A.

In the illustrated embodiment, as shown in FIG. 1A, the rotatable agitator 130 is engaged with an agitator drive mechanism 150 at a driven end 132 and rotates freely at a non-driven end 134 of the rotatable agitator 130. The agitator drive mechanism 150 thus drives the driven end 132 to cause the rotatable agitator 130 to rotate around the rotation axis 2 during use. The drive mechanism 150 may axially engage the driven end 132 of the rotatable agitator 130 without engaging the rotatable agitator 130 with a belt and in a manner that allows the agitator 130 to be easily removed and inserted, as will be described in greater detail below.

Figure 2:
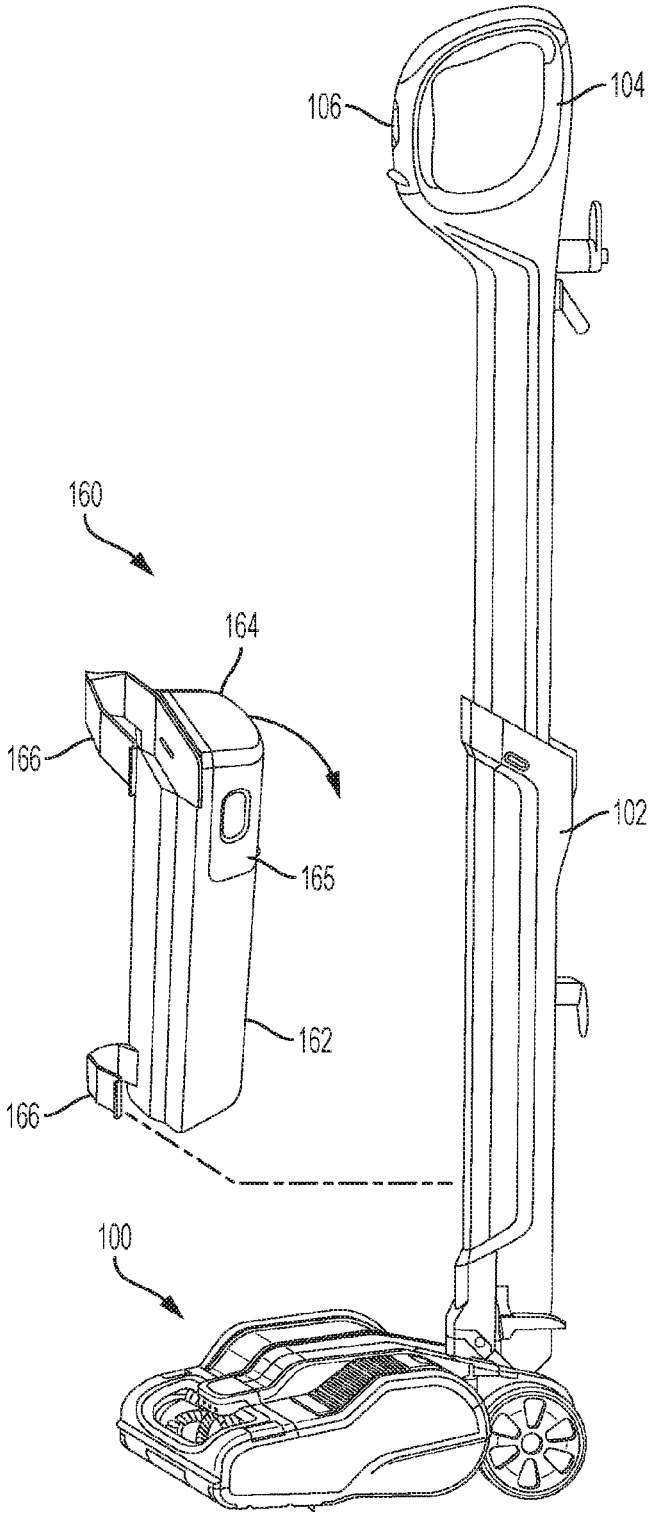
FIG. 2 is a perspective view of a vacuum cleaner with the surface cleaning head shown in FIG. 1 connected to a wand and handle.

As shown in FIG. 2, an agitator caddy 160 may be mounted on the wand 102 for holding one or more spare agitators. The agitator caddy 160 may be removably mounted or fixed to the wand 102. In other embodiments, the agitator caddy 160 may be mounted in other locations on the surface cleaning head 100 or wand 102. The illustrated embodiment of the agitator caddy 160 includes a container 162 sized and configured to receive at least one agitator and a cover 164 pivotably coupled to the container 162 at a hinge 165. In other embodiments, the agitator caddy 160 may include a container without a cover or may include other structures configured to receive and hold an agitator.

The illustrated embodiment of the agitator caddy 160 further includes one or more mounting arms 166 extending from container 162. The mounting arms engage the wand 102 to mount the caddy 160 to the wand 102. The mounting arms 166 may be shaped similar to the contours of the wand 102 and may be dimensioned such that the arms 166 flex and apply pressure against the wand 102 to hold the agitator caddy 160 in place and prevent the caddy 160 from sliding. In other embodiments, the agitator caddy 160 may include other structures for engaging and mounting on the wand 102 and/or surface cleaning head 100.

Figure 4A:
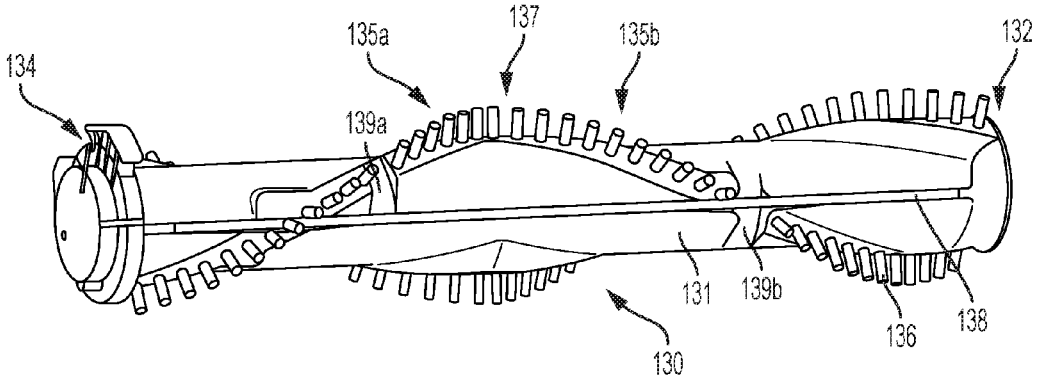
FIGS. 4A and 4B are different perspective views of an embodiment of a brush roll agitator for use in the surface cleaning head shown in FIG. 1.
Figure 4B:
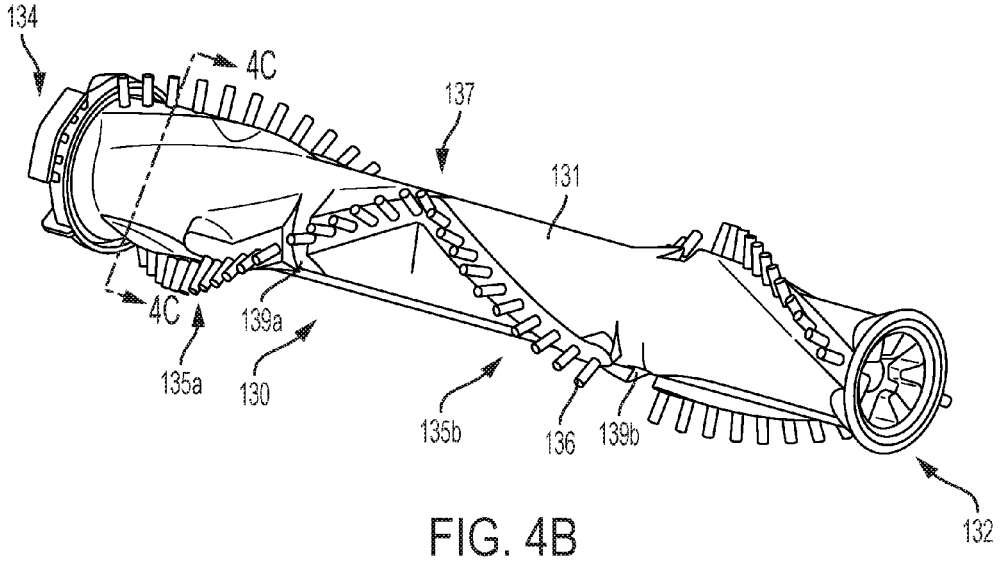
Figure 4C:
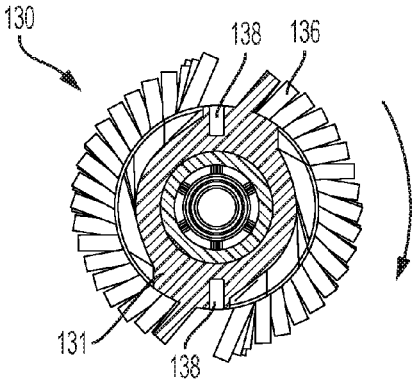
FIG. 4C is a cross-sectional view of the brush roll agitator shown in FIG. 4B taken along line 4C-4C.

In this embodiment, as shown in greater detail in FIGS. 4A-4C, the rotatable agitator 130 is a rotatable brush roll including brush agitator elements 136. The brush agitator elements 136 may include brush bristles, such as nylon bristles, extending substantially radially from an agitator body 131. In this embodiment, the brush agitator elements 136 are arranged in one or more helical patterns 135*a*, 135*b* around the agitator body 131. The helical patterns 135*a*, 135*b* include, for example, opposite helical patterns 135*a*, 135*b* that meet at a location 137 on the agitator body 131, forming a chevron shaped pattern. The location 137 where the helical patterns of agitator elements 136 meet (i.e., the point of the chevron) may correspond to the location of the dirty air inlet 143 in the agitator chamber 120 when the agitator is inserted in the chamber. As shown in FIG. 4C, the agitator elements 136 may be angled relative to radial lines extending radially from an axis of rotation of the agitator 130. In the illustrated embodiment, the agitator elements 136 are angled toward a direction of rotation.

This embodiment of the rotatable agitator 130 also includes one or more cutting grooves 138 extending substantially axially along at least a portion of the agitator body 131. The cutting groove(s) 138 are recessed below a surface of the agitator body 131 and have a depth sufficient to accommodate a cutting tool (e.g., scissors or knife). The cutting tool may thus be inserted beneath strands of hair, string or other types of debris that can get wound around the rotatable agitator 130 during use. The cutting tool may then be translated along the length of the cutting groove 138 to cut hair or other debris entangled around the agitator 130. The rotatable agitator 130 may be manually rotated to allow the cutting groove 138 to be accessed through the top opening 117 or through the bottom opening 119 of the chamber 120. If the rotatable agitator 130 is removable, the agitator 130 may be removed for cutting away the hair and other entangled debris. This embodiment of the rotatable agitator 130 further includes spaces 139*a*, 139*b* to accommodate the bottom guards or bars 111*a*, 111*b* such that the rotatable agitator 130 extends partially through the bottom opening 119 (see FIG. 1A).

The agitator body 131 may be solid, hollow or partially solid/hollow. The agitator body 131 may also include wheel weights to balance the rotatable agitator 130 when driven. One example of the wheel weights (not shown) may include screws threaded into the body 131. A hollow agitator body may not need to be weighted.

A rotatable agitator or brush roll may also include other types of agitator patterns and/or agitator elements including, without limitation, fabric material (e.g., cloth, felt or polyester), a rubber material, and bristles of different thicknesses and/or materials. Rotatable agitators with different agitator patterns and/or agitator elements may be used for different surfaces, functions and/or applications. A rotatable agitator with stiffer bristles may be used, for example, for carpets and/or deep cleaning. A rotatable agitator with softer bristles or fabric may be used, for example, for hardwood floors and/or delicate quick cleaning. Thus, different brush rolls having different agitating characteristics may be easily interchangeable in a surface cleaning head with an openable agitator chamber, consistent with embodiments described herein, to increase the functionality and improve the performance of the vacuum cleaner.

Figure 5A:
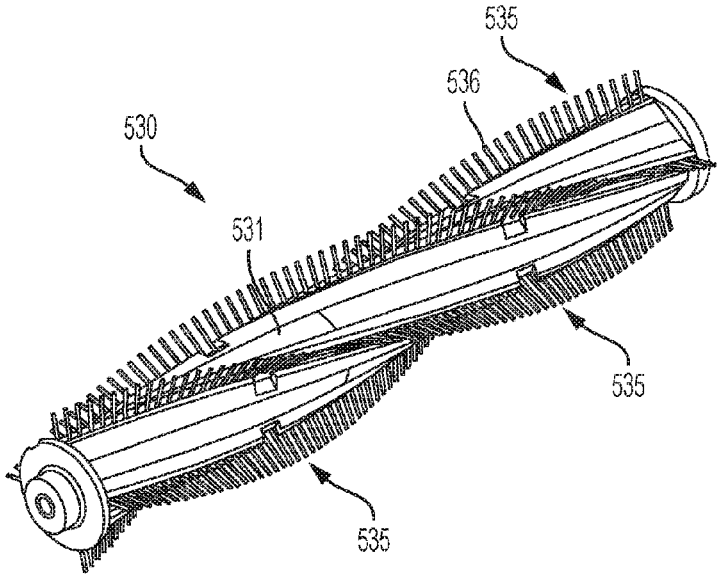
FIGS. 5A and 5B are perspective and side views, respectively, of another embodiment of a brush roll agitator for use in the surface cleaning head shown in FIG. 1.
Figure 5B:
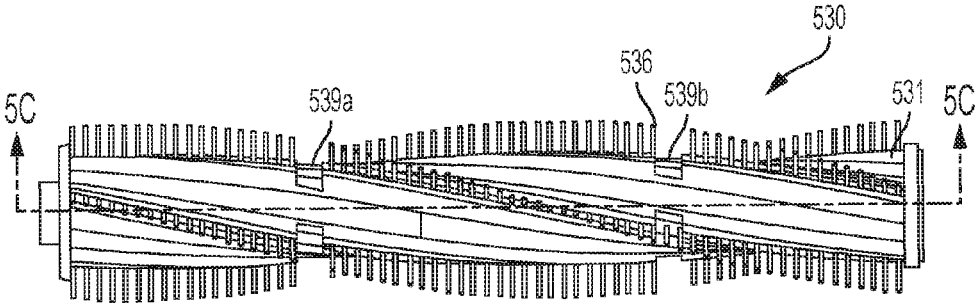
Figure 5C:
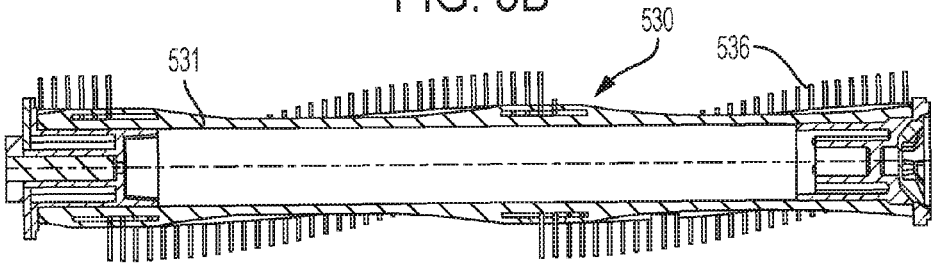
FIG. 5C is a cross-sectional view of the brush roll agitator shown in FIG. 5B taken along line 5C-5C.

As shown in FIGS. 5A-5C, another embodiment of a rotatable agitator 530 includes agitator elements 536 arranged in helical patterns 535 extending from one end to the other end of the agitator body 531. In this embodiment, the agitator elements 536 include bristles extending in a substantially continuous row with two breaks or spaces 539*a*, 539*b* to accommodate the bottom guards or bars 111*a*, 111*b* such that the rotatable agitator 530 extends partially through the bottom opening 119 when positioned in the agitator chamber 120 shown in FIG. 1A.

In this embodiment, the agitator elements 536 may also be different, for example, bristles of a different material, thickness and/or height as compared to the agitator elements 136 in the agitator 130. In one example, the agitator 130 shown in FIGS. 4A-4C may include stiffer nylon bristles for carpet surfaces or deep cleaning applications and the agitator 530 shown in FIGS. 5A-5C may include softer nylon bristles for hard surfaces or delicate applications. The stiffer nylon bristles of the brush roll agitator 130 for the carpet may be thicker (e.g., a diameter of 0.23±0.02 mm) and shorter (e.g., a height from the brush roll agitator body 131 of 8.0±0.6 mm). The softer nylon bristles of the brush roll agitator 530 for the hard surfaces may be thinner (e.g., a diameter of 0.04±0.02 mm) and longer (e.g., a height from the brush roll agitator body 531 of 13±0.2 mm). When the brush roll agitator 530 has longer bristles, the diameter of the brush roll agitator body 531 may be smaller such that the overall outer diameter can fit in the agitator chamber. In the example embodiment, the brush roll agitator 130 with the thicker and shorter bristles has an overall outer diameter of about 54±0.3 mm and the brush roll agitator 530 with the thinner and longer bristles has an overall outer diameter of about 55±0.4 mm.

Figure 6:
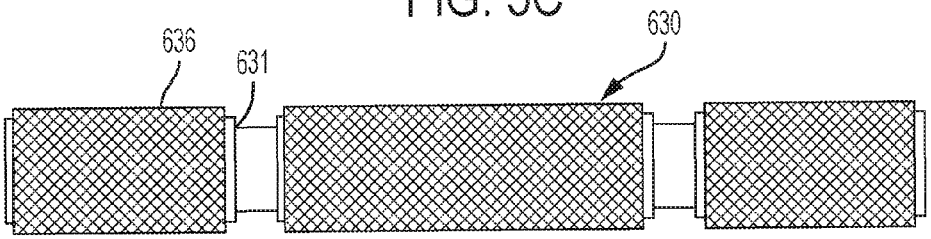
FIG. 6 is a side view of a further embodiment of a rotatable agitator for use in the surface cleaning head shown in FIG. 1.

As shown in FIG. 6, a further embodiment of a rotatable agitator 630 includes fabric material 636 wrapped around at least a portion of an agitator body 631. The fabric material 636 may include, for example, a felt material. This embodiment of the rotatable agitator 630 may also be suited for hard surfaces and/or delicate applications. A rotatable agitator may include any combination of agitator elements such as, for example, a soft agitator element (e.g., a fabric material or soft bristles/brush) and a relatively stiff agitator element (e.g., a rubber blade or stiff bristles/brush).

In further embodiments, a surface cleaning head 100 with an openable agitator chamber 120 may be configured to receive non-driven agitators in addition to driven agitators. A non-driven agitator is configured to engage each side of the agitator chamber 120 without engaging the drive mechanism 150 on the driven side of the chamber. One example of a non-driven agitator includes a body that defines an air inlet, an air outlet and an air path therebetween and a bottom surface with a soft fabric pad. This type of non-driven agitator may also be suited for flat, hard surfaces such as hardwood floors.

Figure 7A:
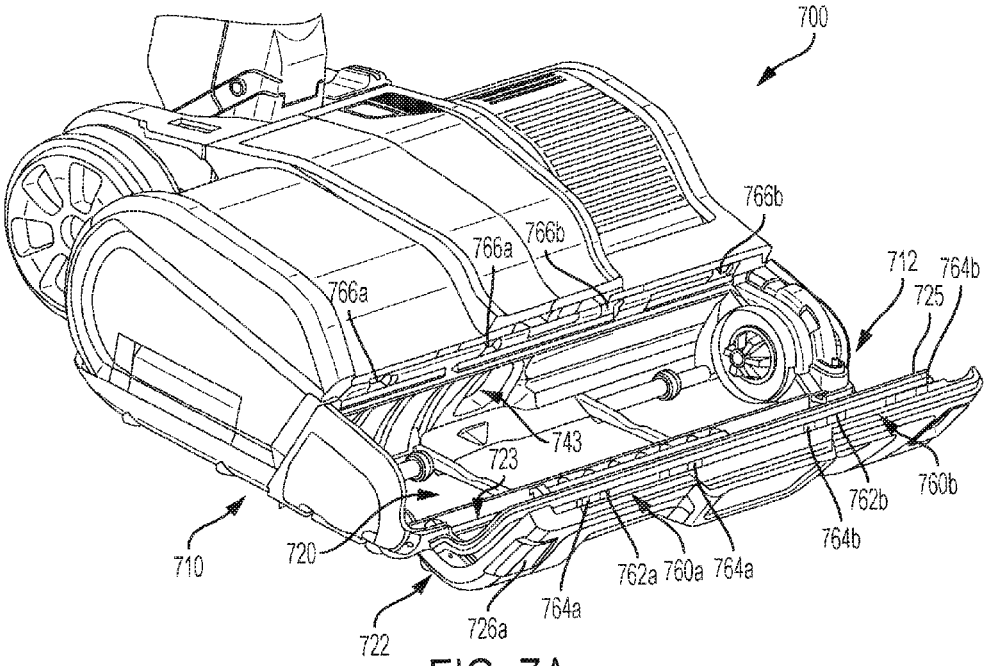
FIGS. 7A and 7B are different side perspective views of a surface cleaning head with an external cover in an open position and with an agitator removed from the agitator chamber, consistent with an embodiment of the present disclosure.
Figure 7B:
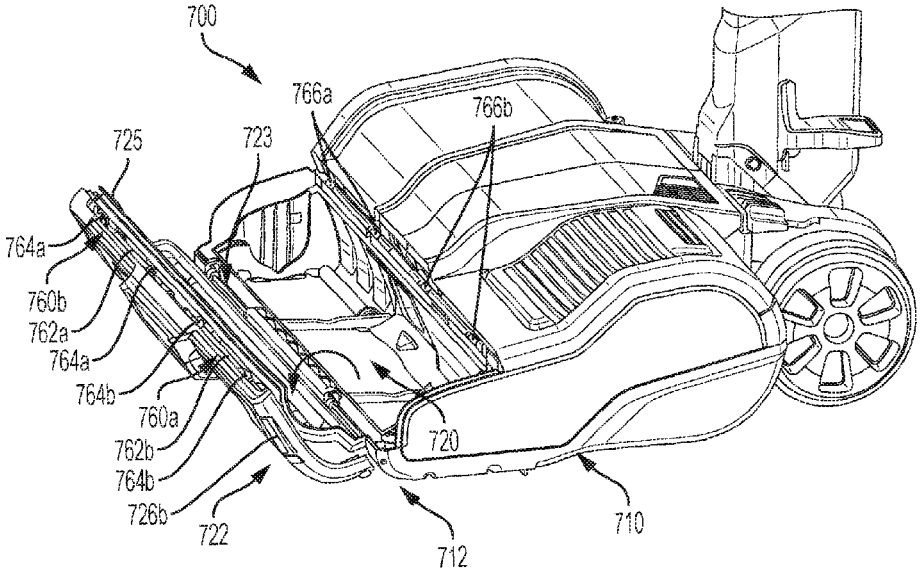
Figure 8:
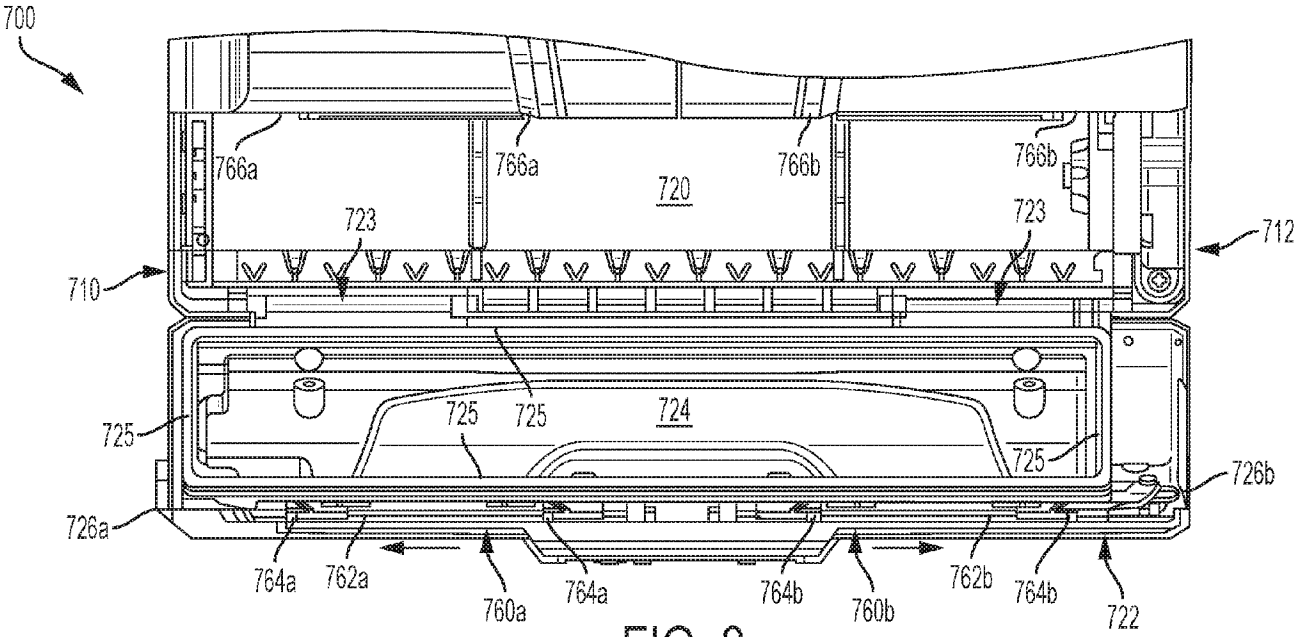
FIG. 8 is a top view of agitator chamber and external cover of the surface cleaning head shown in FIGS. 7A and 7B.
Figure 9:
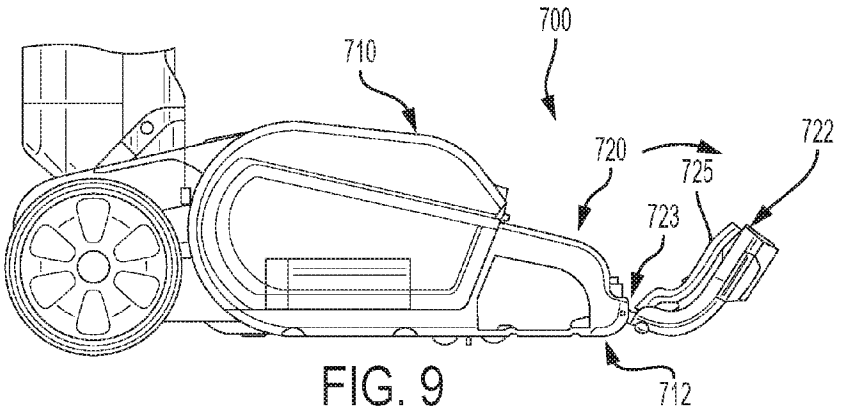
FIG. 9 is a side view of the surface cleaning head shown in FIGS. 7A and 7B.

Referring to FIGS. 7-9, an embodiment of a surface cleaning head 700 with a pivotable external cover 722 is described in greater detail. In this embodiment, the surface cleaning head 700 includes a cleaning head housing 710 including an agitator chamber 720 and the pivotable external cover 722 coupled with a hinge 723 to a front portion 712 of the cleaning head housing 710. The pivotable external cover 722 pivots at the hinge 723 between a closed position (not shown) and an open position (shown). If the pivotable external cover 722 includes lights, the wiring (not shown) for the lights may pass across the hinge 723. In this embodiment, the pivotable external cover 722 pivots forwardly relative to the housing 710 to open the agitator chamber 720 (FIG. 9). In the open position, the agitator chamber 720 is accessible and the agitator may be removed from the agitator chamber 720 as shown. This embodiment of the surface cleaning head 700 may also be used with a rotatable agitator that is not removable such that the pivotable external cover 722 is opened merely to remove the debris that has collected on the rotatable agitator. The pivotable external cover 722 may also include a transparent window 724 extending across a central region of (FIG. 8) for viewing the agitator chamber 720 when the cover is in the closed position.

A sealing member 725 may also be located between the pivotable external cover 722 and the cleaning head housing 710 and around the perimeter of the agitator chamber 720. A rotatable driven agitator (not shown) may thus be mounted in the agitator chamber 720 inside of the sealing member 725. In the illustrated embodiment, the pivotable external cover 722 includes the sealing member 725 extending around an inside perimeter of the cover 722. In the closed position, the sealing member 725 seals against the cleaning head housing 710 around the perimeter of the agitator chamber 720. The sealing member 725 is capable of forming a substantially air tight seal at the interface between the cover 722 and the cleaning head housing 710 with substantially equal pressure around the perimeter of the chamber 720 to prevent air and/or debris from passing through.

The sealing member 725 may be made of an elastomeric material or other suitable sealing material and may have any known configuration capable of forming a seal against a flat face or rib. A lip seal or face seal, for example, may be used on the pivotable external cover 722 to facilitate alignment and sealing when the cover pivots to the closed position. In other embodiments, the sealing member 725 may be provided on the cleaning head housing 710.

The surface cleaning head 700 may also include a latch mechanism to secure the pivotable external cover 720 in the closed position. The latch mechanism may provide multiple points of engagement around the perimeter between the external cover 720 and the cleaning head housing 710 such that the sealing member 725 is engaged with substantially equal pressure around the perimeter of the chamber 720.

In the illustrated embodiment, the pivotable external cover 722 includes latch mechanisms 770*a*, 770*b* on an opposite side from the hinge 723. The latch mechanisms 770*a*, 770*b* may include slidable actuators 772*a*, 772*b* with hooks 774*a*, 774*b* that releasably engage slots 776*a*, 776*b* on the cleaning head housing 710. Each of the latch mechanisms 770*a*, 770*b* include two hooks 774*a*, 774*b* to provide four spaced apart points of engagement between the cover 720 and the housing 710.

The slidable actuators 772*a*, 772*b* translate in a transverse direction between a latched position and an unlatched position. The slidable actuators 772*a*, 772*b* may be biased into the latched position, for example, by springs (not shown). The slidable actuators 772*a*, 772*b* are operably coupled to latch releases 726*a*, 726*b* for moving the slidable actuators 772*a*, 772*b* against the spring bias, thereby releasing the hooks 774*a*, 774*b* from the slots 776*a*, 776*b* (as indicated by the arrows in FIG. 8). In other embodiments, the latch mechanisms 770*a*, 770*b* may be located on the cleaning head housing 110 and the slots 776*a*, 776*b* may be located on the external cover 722. Although two latch mechanisms and four hooks are shown, other numbers of latch mechanisms and hooks may also be used.

Figure 10:
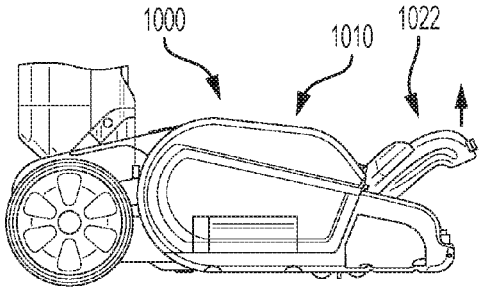
FIG. 10 is a side view of a surface cleaning head including an external cover that pivots rearwardly, consistent with another embodiment of the present disclosure.
Figure 11:
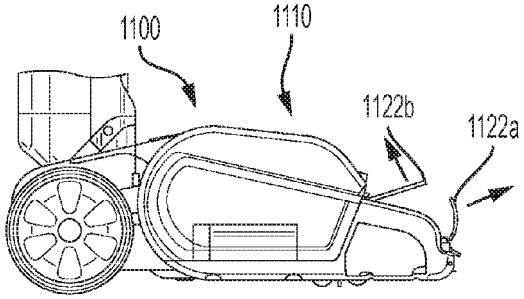
FIG. 11 is a side view of a surface cleaning head including a multiple piece external cover, consistent with a further embodiment of the present disclosure.
Figure 12:
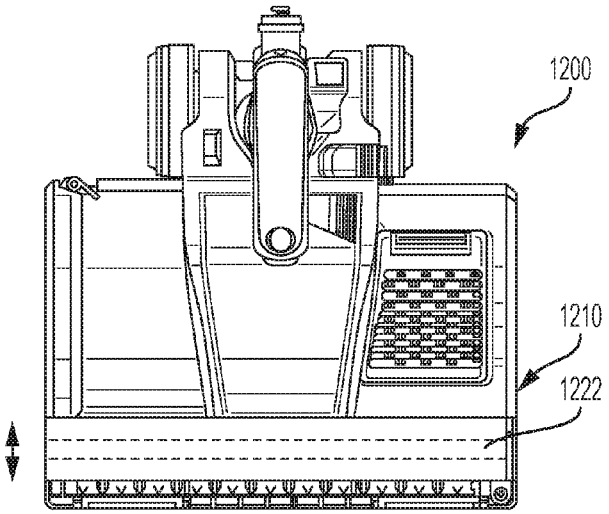
FIG. 12 is a top view of a surface cleaning head including an external cover that slides rearwardly or forwardly to open the agitator chamber, consistent with another embodiment of the present disclosure.
Figure 13:
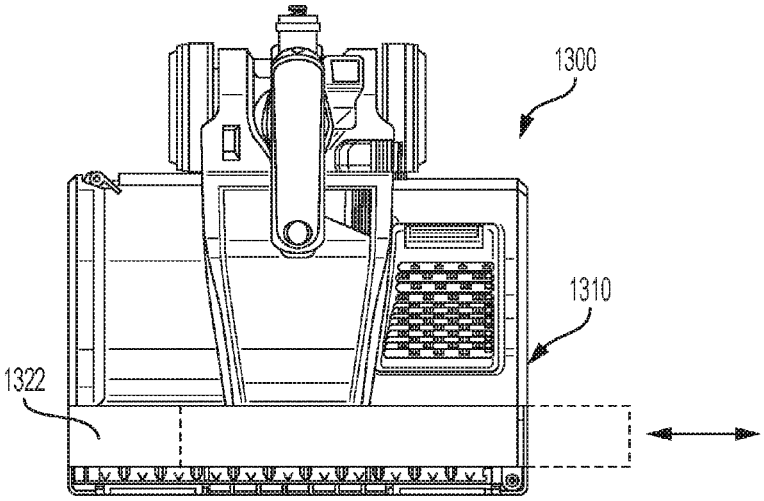
FIG. 13 is a top view of a surface cleaning head including an external cover that slides to a side to open the agitator chamber, consistent with another embodiment of the present disclosure.

A movable external cover may also have other configurations, for example, as shown in FIGS. 10-13. FIG. 10 shows another embodiment of a surface cleaning head 1000 with a pivotable external cover 22 that pivots rearwardly relative to the cleaning head housing 1010 to the open position. FIG. 11 shows a further embodiment of a surface cleaning head 1100 with multiple-piece pivotable external cover including one cover portion 1122*a* that pivots forwardly and another cover portion 1122*b* that pivots rearwardly relative to the cleaning head housing 1110. FIG. 12 shows yet another embodiment of a surface cleaning head 1200 with a slidable external cover 1222 that slides or rolls in a longitudinal direction relative to the cleaning head housing 1210, for example, similar to a garage door. FIG. 13 shows a further embodiment of a surface cleaning head 1300 with a slidable external cover 1322 that slides laterally relative to the cleaning head housing 1310.

In any of these embodiments, the external cover may be latched, for example, using a latching mechanism as described above or any other latching mechanism. In any of these embodiments, the external cover may be sealed, for example, using a sealing member as described above or any other sealing member. In each of these embodiments, the external cover may be moved between open and closed positions while remaining engaged with the surface cleaning head housing. In other embodiments, the external cover may be completely removed from the surface cleaning head housing. Other variations and locations for the external cover are also within the scope of the present disclosure.

Figure 14:
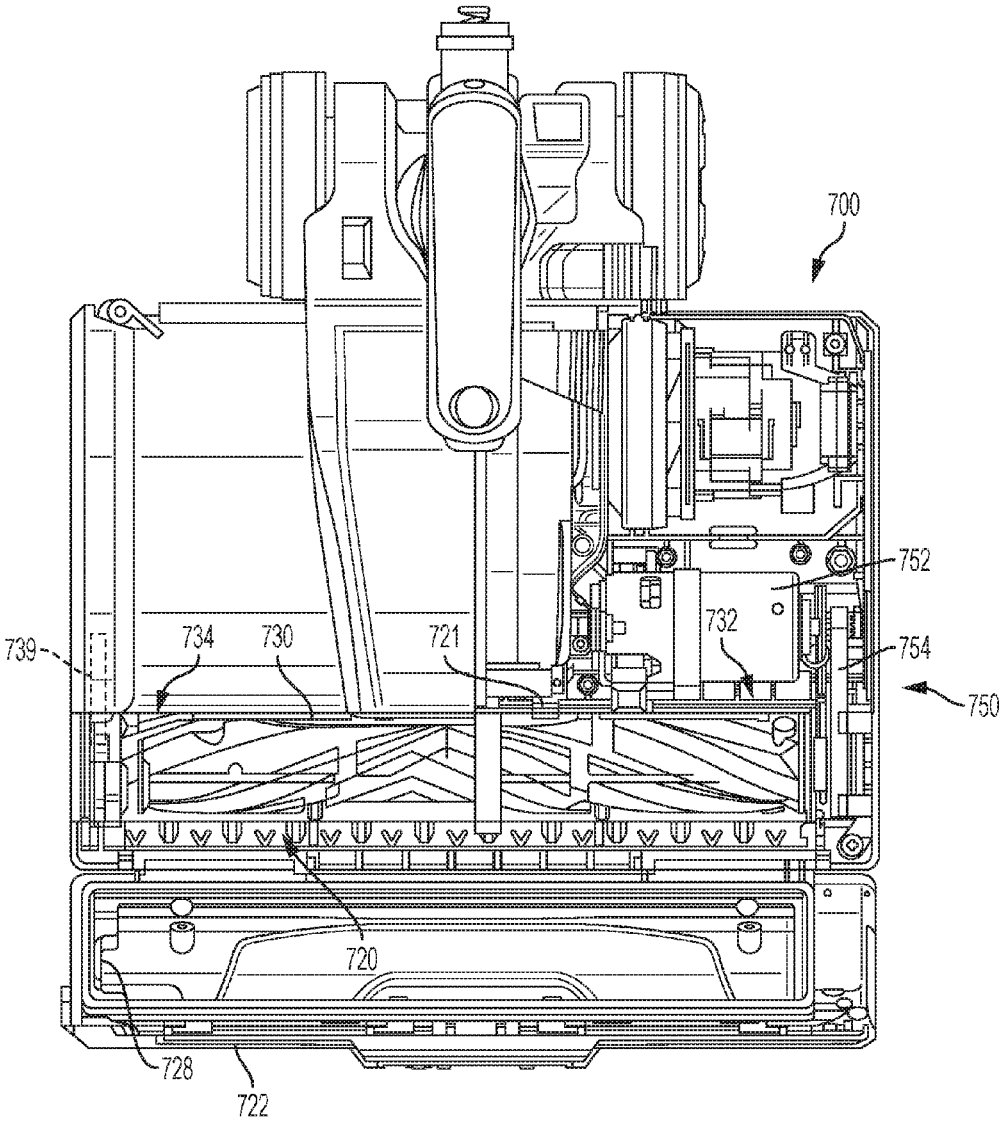
FIG. 14 is a top view of the surface cleaning head shown in FIG. 7 including a rotatable agitator and a drive mechanism, consistent with an embodiment of the present disclosure.

Referring to FIG. 14, this embodiment of the surface cleaning head 700 may receive a removable rotatable agitator 730 that is driven by a drive mechanism 750. In this embodiment, the drive mechanism 750 axially engages a driven end 732 of the rotatable agitator 730 at a driven side of an agitator chamber 720 and a non-driven end 734 of the rotatable agitator 730 is mounted to rotate freely at a non-driven side of the agitator chamber 720. Both the driven end 732 and the non-driven end 734 of the removable rotatable agitator 730 are mounted in the agitator chamber 720 in a manner that allows the agitator 730 to be removed when the external cover 722 is in an open position.

In this embodiment, the external cover 722 is configured to secure the removable rotatable agitator 730 in the agitator chamber 720. The external cover 722 includes, for example, an engaging structure 728 that engages the non-driven end 734 of the removable rotatable agitator 730. In other embodiments, an agitator engaging member 739 may be movably mounted to the surface cleaning head housing 710 for movement into engagement with the non-driven end 734 of the removable rotatable agitator 730. The agitator engaging member 739 is shown schematically but may be in the form of a clip, slide or latch and may slide and/or pivot in to and out of engagement with the agitator 130.

Although this embodiment shows a pivotable external cover 722 similar to that shown and described above, the removable rotatable agitator 730 in this embodiment may also be used with other types of openable external covers (e.g., as shown in FIGS. 10-13).

The surface cleaning head 700 may also include a kill switch that stops power to the drive mechanism 750 when the pivotable external cover 722 is in the open position. A kill switch actuator 721 is located at a point along the perimeter of the agitator chamber 720 to activate the kill switch when the pivotable external cover 722 is opened. In the example embodiment, the kill switch actuator 721 is biased to an open position that opens the kill switch. When the pivotable external cover 722 is in the closed position, the cover 722 engages the kill switch actuator 721 to close the kill switch, allowing power to the drive mechanism 750. When the pivotable external cover 722 moves to the open position, the actuator 721 moves to the biased open position to open the kill switch, stopping power to the drive mechanism 750. In one embodiment, the kill switch actuator 721 may be recessed to prevent being actuated by a user and may be actuated by a protrusion (e.g., a small rod) extending from the cover 722. The actuator 721 may also be in other locations and may be actuated in other ways.

Figure 15:
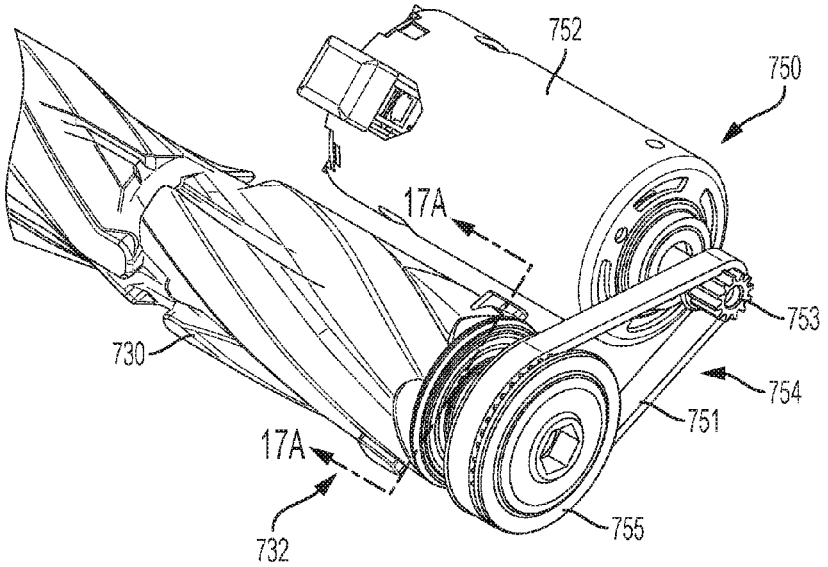
FIG. 15 is a top perspective view of an embodiment of a drive mechanism for use in the surface cleaning head shown in FIG. 14.
Figure 16:
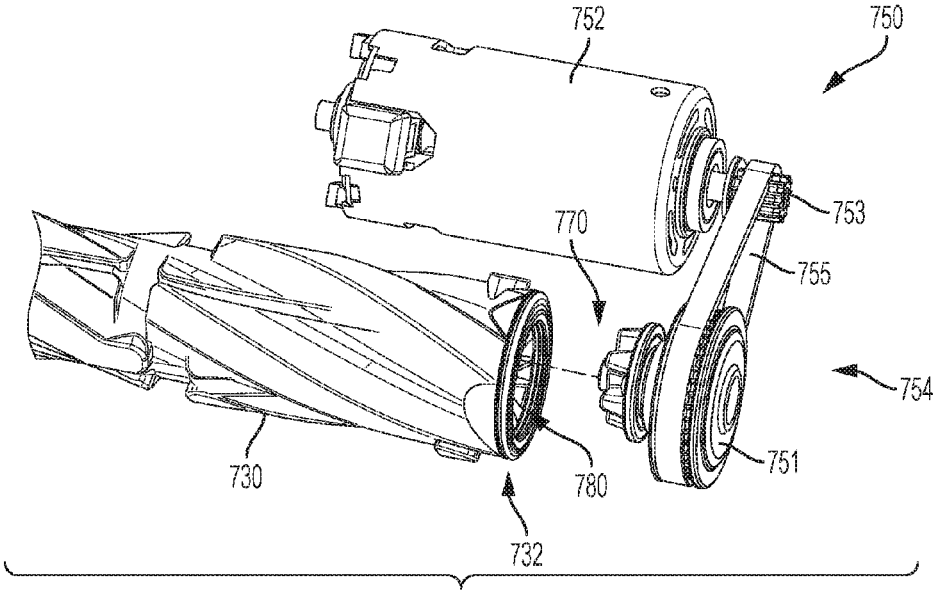
FIG. 16 is an exploded view of the drive mechanism shown in FIG. 15.

As shown in greater detail in FIGS. 15 and 16, the drive mechanism 750 includes a motor 752, a rotation transfer mechanism 754, and a splined drive member 770. In this embodiment, the rotation transfer mechanism 754 includes a belt 755 frictionally engaging a drive wheel 753 coupled to the output of the motor 752 and frictionally engaging a driven wheel 755 coupled to the splined drive member 770. The drive mechanism 750 may be capable of rotating the agitator 730 at low speeds of 700±100 RPM and high speeds of 3500±500 RPM. In other embodiments, other rotation transfer mechanisms may be used including, without limitation, a gear train or a direct drive coupling between the motor and the splined drive member. In other embodiments, a motor may be located internally within the rotatable agitator. In further embodiments, the drive mechanism may include other mechanisms capable of imparting rotation to the rotatable agitator including, without limitation, an air driven turbine.

Figure 17:
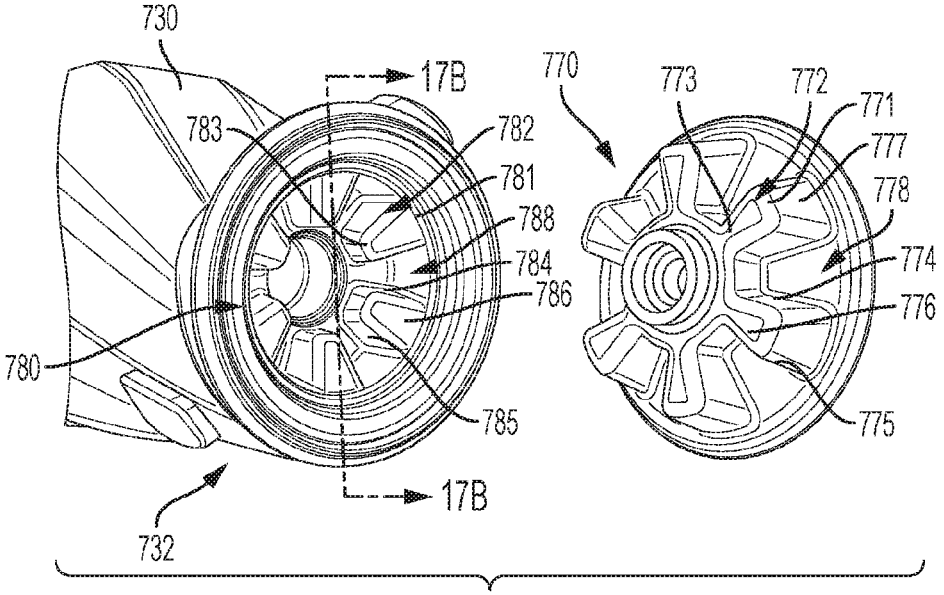
FIG. 17 is a close-up perspective view of a splined drive member and a splined driven member of the drive mechanism shown in FIG. 15.

As shown in greater detail in FIG. 17, the driven end 732 of the removable rotatable agitator 730 includes a splined driven member 780 configured to mate axially with the splined drive member 770. The splined drive member 770 and the splined driven member 780 thus form a spline coupling or joint that transmits rotation and torque without using a belt. The splined drive member 770 and the splined driven member 780 have spline teeth 772, 782 oriented radially relative to an axis of rotation of the agitator. The spline teeth 772, 782 have corresponding shapes and spaces 778, 788 between the spline teeth 772, 782 such that the spline teeth 772, 782 mesh when the members 770, 780 are axially engaged, as shown in FIG. 17A.

The illustrated embodiment shows the splined drive member 770 with external splines and the splined driven member 780 with internal splines. In other embodiments, the splined drive member 770 may include the internal splines and the splined driven member 780 may include the external splines.

Figure 17A:
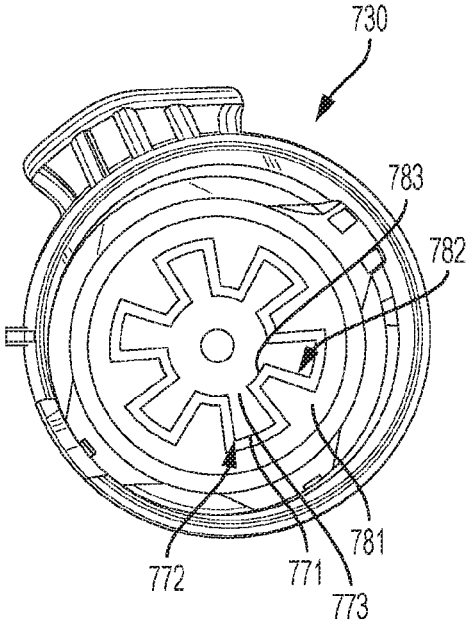
FIG. 17A is a cross-sectional view of a spline coupling between the splined drive member and the splined driven member taken along line 17A-17A in FIG. 15.
Figure 17B:
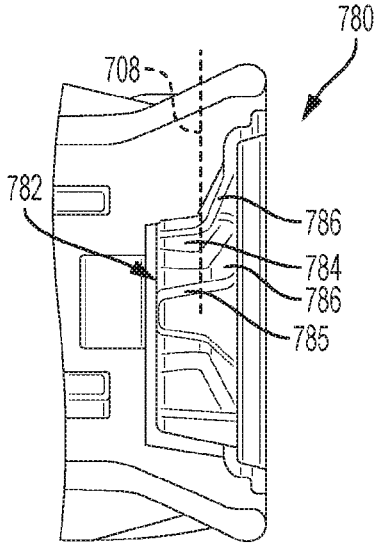
FIG. 17B is a side cross-section view of the splined driven member taken along line 17B-17B in FIG. 17.

In the illustrated embodiment, the spline teeth 772, 782 on the splined drive member 770 and the splined driven member 780 are both generally wedge shaped with a radially outer portion 771, 781 being wider than a radially inner portion 773, 783 (see FIG. 17A). The spline teeth 772, 782 also have tapered side walls 774, 775, 784, 785 that taper outwardly from radial faces 776, 786 of the spline teeth 772, 782. As shown in FIG. 17B, the spline teeth 782 on the splined driven member 780 also have a tapered or chamfered radial face 786 that tapers inwardly (i.e., toward the non-driven end of the agitator) and forms an acute angle relative to a radial line 708 in a range of about 30° to 60°. The spline teeth 772 on the splined drive member 770 may have a tapered or chamfered axial face 777 that tapers inwardly toward the axis of rotation.

The shape and configuration of the spline teeth 772, 782 in the illustrated embodiment provide self-alignment and facilitate engagement of the splined driven member 780 with the splined drive member 770. The splined drive member 770 and the splined driven member 780 may be engaged in a number of different angular positions and thus do not require a precise angular alignment for engagement. The shape and configuration of the spline teeth 772, 782 in the illustrated embodiment may also reduce or eliminate backlash when the splined drive member 770 drives the splined driven member 780.

One or both of the splined driven member 780 and splined drive member 770 may also be made of an elastomeric material such as a thermoplastic rubber having a higher durometer (e.g., 90 or greater). The elastomeric material may facilitate engagement of the spline teeth 772, 782 and may provide vibration reduction or isolation when the splined drive member 770 drives the splined driven member 780. Thus, the drive mechanism 750 may rotate the agitator 730 at higher RPMs with reduced vibrations.

In the illustrated embodiment, each of the splined drive member 770 and the splined driven member 780 have six (6) spline teeth 772, 782 arranged in a star configuration around an axis of rotation. The six spline teeth are capable of withstanding the desired drive forces and torques while also facilitating alignment and preventing backlash; however, other numbers of spline teeth may be possible. Other shapes and configurations of the spline teeth on the splined drive member 770 and splined driven member 780 may also be possible. Furthermore, other couplings or mechanisms for axially coupling rotating shafts to transmit torque and rotation may also be used including, without limitation, a dog clutch, a non-slip clutch, a Hirth joint and a curvic coupling.

Figure 18:
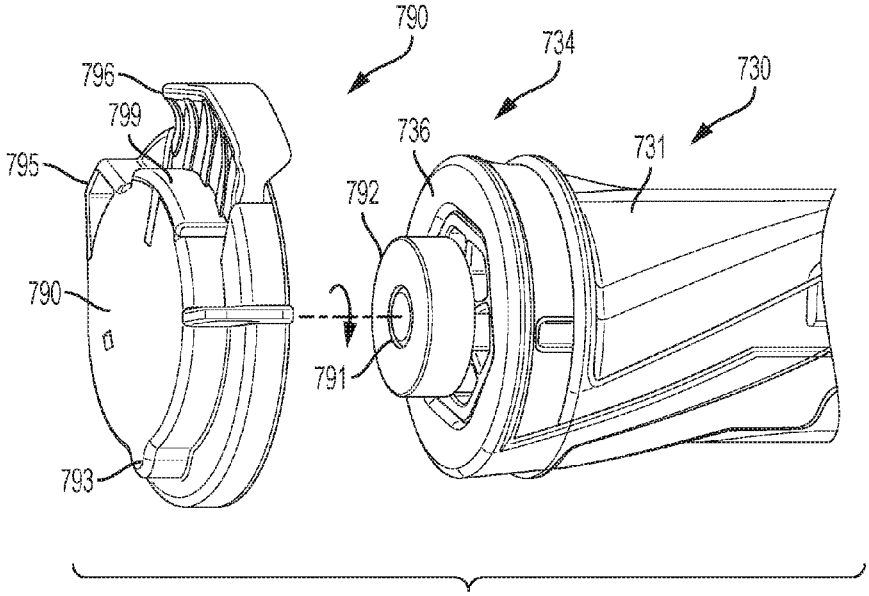
FIG. 18 is an exploded view of a non-driven end of an embodiment of a rotatable agitator for use in the surface cleaning head shown in FIG. 14.

As shown in greater detail in FIG. 18, the non-driven end 734 of this embodiment of the removable rotatable agitator 730 includes an end cap 790 secured to a bushing 792 that is rotatably mounted on an axle 791. The axle 791 is fixed within and extending from the agitator body 731. The end cap 790 is configured to be supported within the agitator chamber 720 and to secure the bushing 792 such that the axle 791 rotates within the bushing 792 and the rotatable agitator 730 spins about its axis of rotation. In this embodiment, the end cap 790 is removably secured to the bushing 792 with a friction fit but the end cap 790 may also fixed to the bushing 792. In other embodiments, the bushing 792 may be configured to be mounted directly within the agitator chamber 720 without an end cap. Various other configurations may also be used to rotatably support the non-driven end 734 of the rotatable agitator 730 within the agitator chamber 720.

Figure 19:
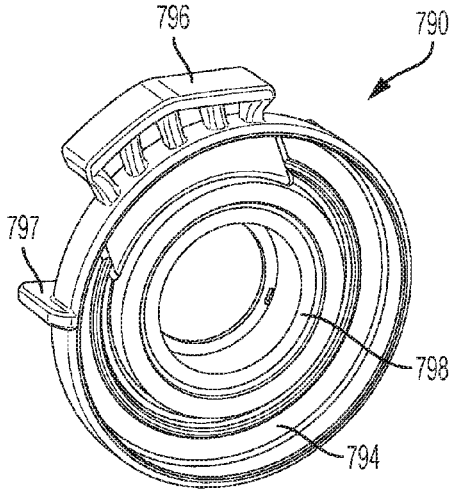
FIGS. 19 and 20 are different side perspective views of an embodiment of an end cap for use on the rotatable agitator shown in FIG. 18.
Figure 20:
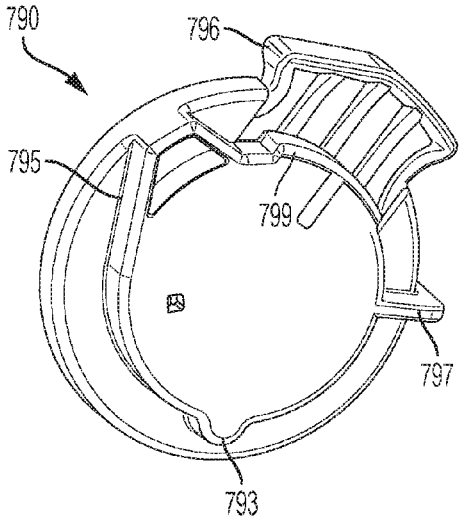

As shown in greater detail in FIGS. 19 and 20, the end cap 790 includes a tab 796 that is shaped to be easily gripped for removing the non-driven end 734 of the agitator 730 from the agitator chamber 720. The end cap 790 also includes one or more stabilizing structures 793, 795, 797 that engage mating structures within the agitator chamber to prevent the end cap 790 from rotating such that the bushing 792 is held stationary, thereby allowing the axle 791 to rotate freely within the bushing 792 when the rotatable agitator is driven at the driven end 732. This embodiment of the end cap 790 also includes an elastomeric pad 799 that engages the engaging structure 728 on the external cover 722 when the cover is closed to secure the agitator 730 in the agitator chamber 720. The end cap 790 further includes an elastomeric ring 798 to frictionally engage the bushing 792. The elastomeric pad 799 and the elastomeric ring 798 may advantageously prevent or isolate vibrations when the agitator 730 is rotating in the agitator chamber 720 and may both be molded together from the same rubber material. The end cap 790 may further include a washer 794 (e.g., a felt washer) that contacts an end surface 736 of the agitator body 731 to keep dirt away from the bearing 792.

Figure 21:
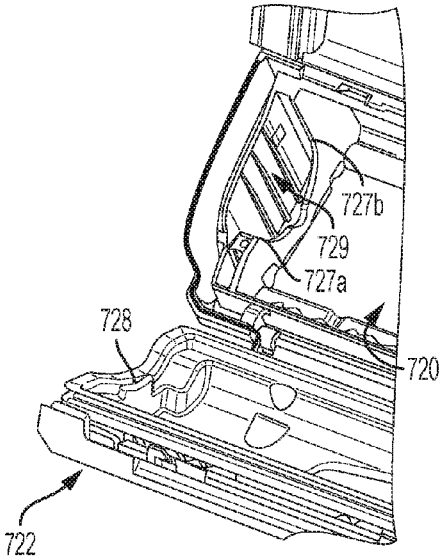
FIG. 21 is a top perspective view of a non-driven side of the agitator chamber in the surface cleaning head of FIG. 14 without the rotatable agitator.
Figure 22:
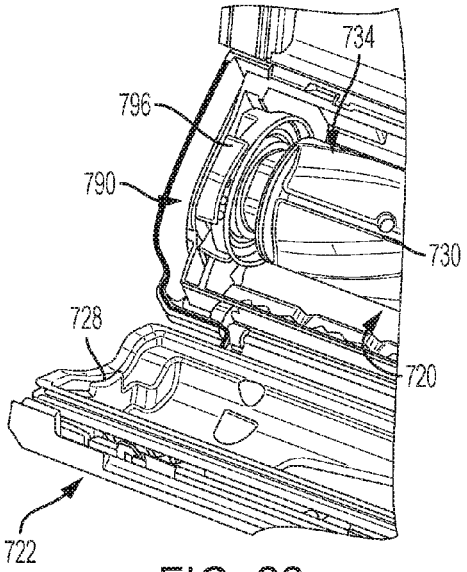
FIG. 22 is a top perspective view of the non-driven side of the agitator chamber in the surface cleaning head of FIG. 14 with the non-driven end of the rotatable agitator received therein.
Figure 23:
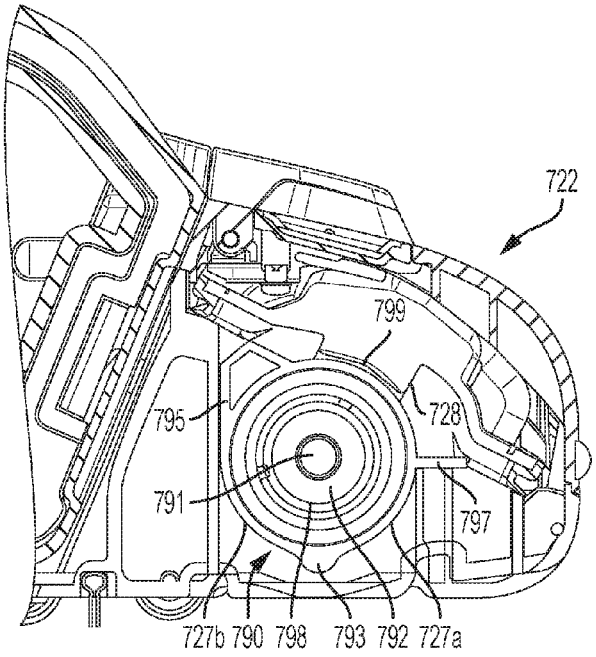
FIG. 23 is a cross-sectional view of the end cap of the agitator seated in the agitator chamber in the surface cleaning head of FIG. 14 with the cover closed.

Referring to FIGS. 21-23, the engagement of the end cap 790 with the agitator chamber 720 is described in greater detail. At the non-driven side, the chamber 720 includes mounting rails 727*a*, 727*b* defining a recessed region 729 that receives an end portion of the end cap 790. The end portion of the end cap 790 may thus slide between the mounting rails 727*a*, 727*b* as shown in FIG. 22. As shown in FIG. 23, the stabilizing structures 793, 795, 797 engage corresponding structures on the mounting rails 727*a*, 727*b* and the engaging structure 728 inside of the cover 722 engages the elastomeric pad 799. Thus, the end cap 790 and the bushing 792 remain stationary when the agitator 730 is rotated. Additionally or alternatively, the cover 722 may engage other portions of the end cap 790 (e.g., the tab 796) to hold the end cap 790 in the chamber 720. In this embodiment, the stabilizing structures 793, 795, 797 have a particular configuration designed or keyed to mate with the mounting rails 727*a*, 727*b* (see FIG. 23) in a particular orientation such that the end cap 790 is properly positioned to be engaged by the cover 722.

To mount the rotatable agitator 730 within the agitator chamber 720, the driven end 732 is angled into the chamber 720 to engage the splined drive member 770 with the splined driven member 780 (see FIG. 16). The end cap 790 may then be used to lower the non-driven end 734 of the agitator 730 into the chamber 720 until the end cap 790 is fit between the mounting rails 727*a*, 727*b* (see FIG. 22). When the agitator 730 is properly seated within the chamber 720, the external cover 722 may then be closed to cover the chamber 720 and to secure the rotatable agitator 730 within the chamber 720. To remove the rotatable agitator 730, the user may grasp the tab 796 to slide the end cap 790 out from between the mounting rails 727*a*, 727*b* and thus lift the non-driven end 734 out of the chamber 720. The user may then continue to lift the agitator 730 until the splined drive member 770 and the splined driven member 780 are disengaged. The user may then clean the agitator 730 and/or insert another type of agitator.

Figure 24:
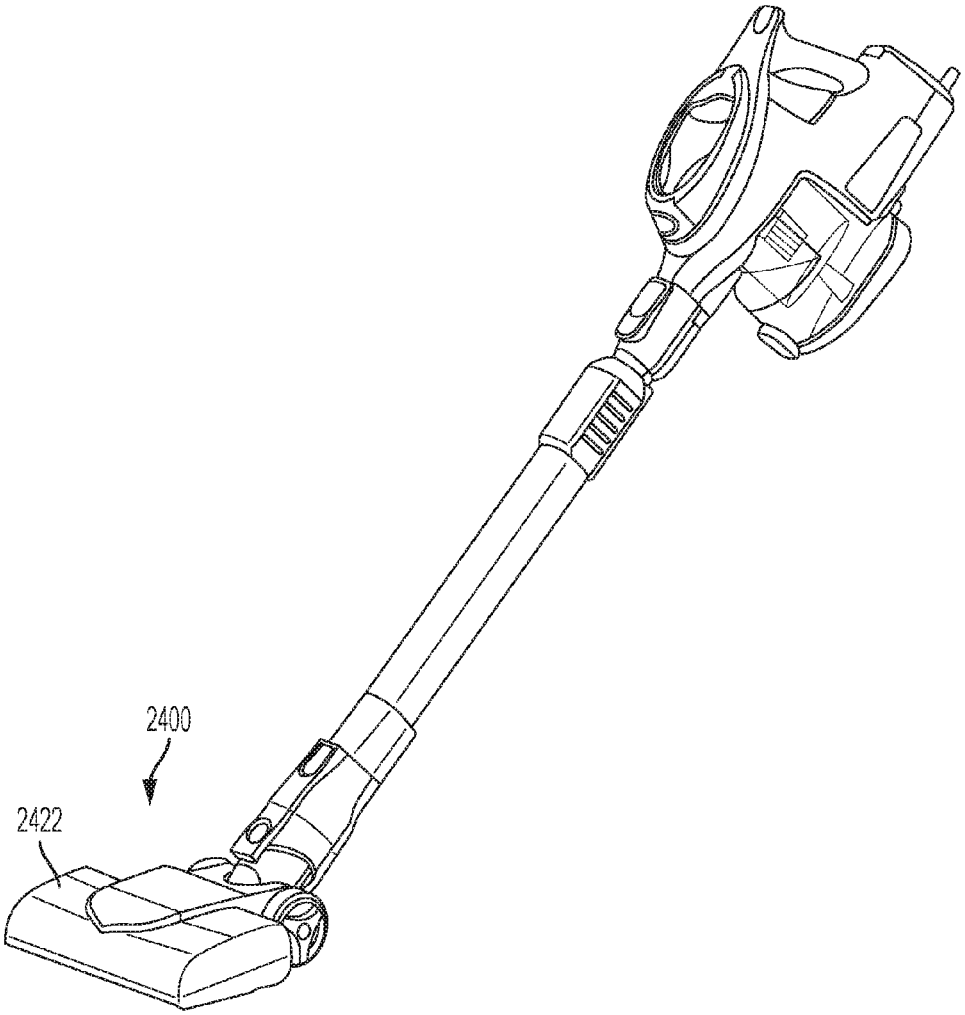
FIG. 24 is a perspective view of a stick vacuum cleaner including a cleaning head with an openable agitator chamber, consistent with a further embodiment of the present disclosure.

Referring to FIG. 24, a surface cleaning head 2400 of a stick vacuum cleaner may include an openable agitator chamber covered by an external cover 2422 and containing a removable agitator. The external cover 2422 and the openable chamber and removable agitator located in the surface cleaning head 2400 may be implemented according to any of the embodiments described herein.

Figure 25:
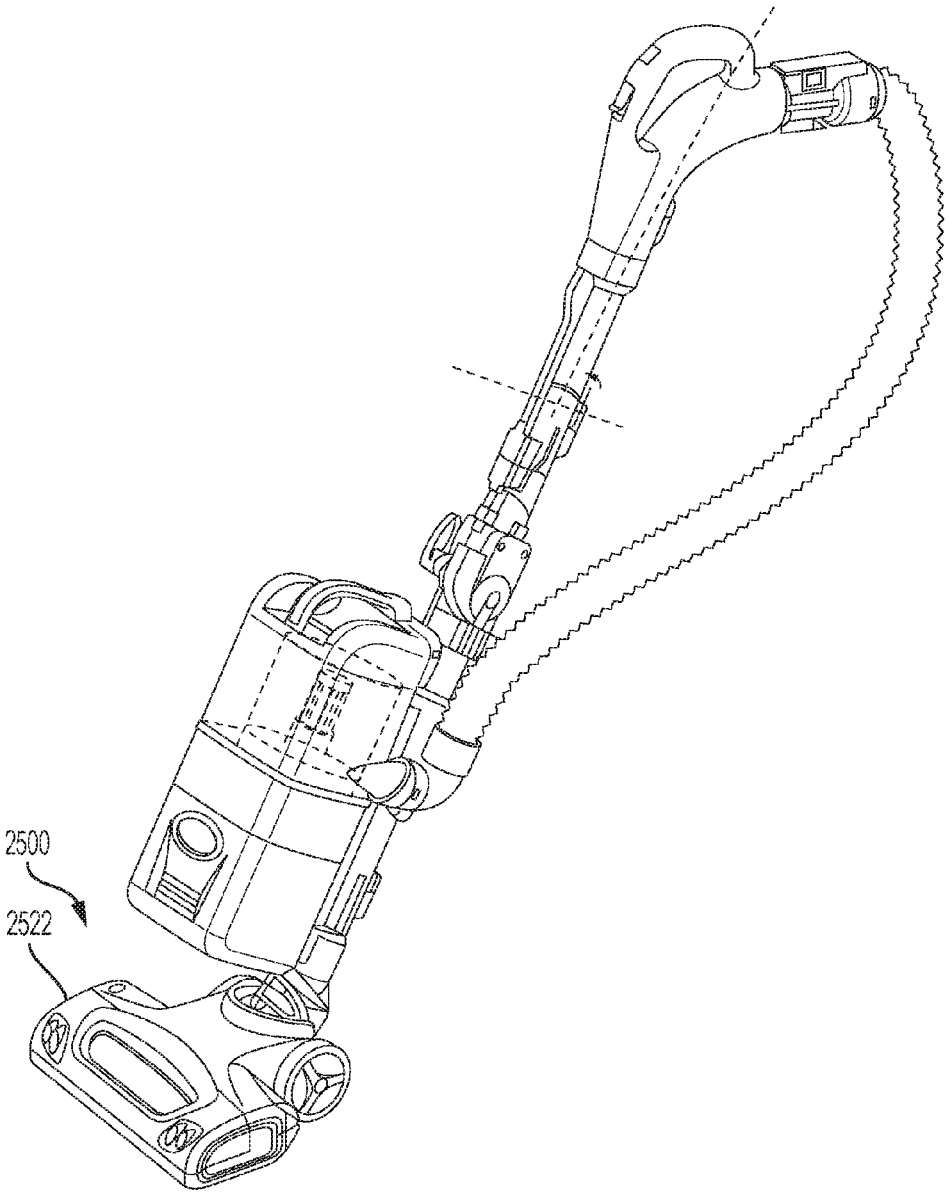
FIG. 25 is a perspective view of an upright vacuum cleaner including a cleaning head with an openable agitator chamber, consistent with yet another embodiment of the present disclosure.

Referring to FIG. 25, a surface cleaning head 2500 of an upright vacuum cleaner may include an openable agitator chamber covered by an external cover 2522 and containing a removable agitator. The external cover 2522 and the openable chamber and removable agitator located in the surface cleaning head 2500 may be implemented according to any of the embodiments described herein.

Accordingly, a surface cleaning head, consistent with embodiments of the present disclosure, includes an openable agitator chamber to facilitate inspection, cleaning, servicing, and/or replacement of an agitator in the surface cleaning head. A removable rotatable agitator includes a drive mechanism that axially engages a driven end of the agitator and thus further facilitates cleaning and/or replacement.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus may embody any one or more of the features contained herein and that the features may be used in any particular combination or sub-combination. Modifications and substitutions by one of ordinary skill in the art are considered to be within the scope of the present invention, which is not to be limited except by the following claims.

What is claimed is:

1. A surface cleaning head for a vacuum, the surface cleaning head comprising:

a cleaning head housing having a front end portion, a rear end portion, laterally disposed sides, an upper portion and a bottom portion, wherein the upper portion extends over the bottom portion of the cleaning head housing;

an agitator chamber located in the front end portion of the cleaning head housing, the agitator chamber having a top opening through the upper portion of the cleaning head housing and a bottom opening through the bottom portion of the cleaning head housing, and wherein the agitator chamber includes a non-driven side and a driven side;

an agitator drive mechanism including a drive member at the driven side of the agitator chamber and an agitator drive motor drivingly coupled to the drive member;

an external cover movably mounted to the cleaning head housing for covering the top opening of the agitator chamber at the front end portion of the cleaning head housing, the external cover being movable between a closed position and an open position by pivoting about a hinge pivotally coupling the external cover to a front bottom edge of the cleaning head housing and in a direction away from the rear end portion of the cleaning head housing, wherein the top opening of the agitator chamber is covered when the external cover is in the closed position and accessible through the top opening when the external cover is in the open position, and wherein at least part of the upper portion remains over the bottom portion when the external cover is in the open position; and a rotatable driven agitator removably mounted within the agitator chamber such that the agitator is configured to contact a surface through the bottom opening, wherein the agitator is accessible and removable through the top opening when the external cover is in the open position, wherein the rotatable driven agitator includes a non-driven end mounted at the non-driven side of the agitator chamber such that the agitator spins freely at the non-driven end and a driven end including a driven member, wherein the driven member mates axially and engages with the drive member of the drive mechanism such that the drive member transmits torque and rotation to the driven member and the rotatable driven agitator.

2. The surface cleaning head of claim 1 wherein the drive member transmits torque and rotation to the driven member and the rotatable driven agitator without a belt.

3. The surface cleaning head of claim 1 wherein the drive member is a splined drive member and the driven member is a splined driven member.

4. The surface cleaning head of claim 3 wherein the splined drive member and splined driven member have wedge-shaped spline teeth.

5. The surface cleaning head of claim 4 wherein the wedge-shaped spline teeth of the splined driven member have chamfered radial faces.

6. The surface cleaning head of claim 5 wherein the wedge-shaped spline teeth of the splined drive member and the splined driven member have tapered side walls.

7. The surface cleaning head of claim 3 wherein the splined drive member and the splined driven member include six spaced spline teeth arranged in a star configuration around an axis of rotation.

8. The surface cleaning head of claim 1 wherein at least one of the drive member and the driven member is made of a thermoplastic material having a durometer of at least about 90.

9. The surface cleaning head of claim 1 wherein the motor is coupled to the drive member using a belt.

10. The surface cleaning head of claim 1 wherein the external cover engages the non-driven end of the agitator in the closed position to hold the agitator in the agitator chamber and wherein the external cover disengages from the non-driven end of the agitator when moved to the open position.

11. The surface cleaning head of claim 1 further comprising an agitator engaging member movably mounted to the cleaning head housing for movement into engagement with the non-driven end of the rotatable driven agitator to hold the agitator in the agitator chamber.

12. The surface cleaning head of claim 1, wherein the drive member includes wedge-shaped spline teeth having chamfered axial faces tapering inwardly toward the axis of rotation.

13. The surface cleaning head of claim 10, wherein the external cover includes an engaging structure protruding from an inside portion of the external cover for engaging the non-driven end of the rotatable driven agitator in the closed position to hold the agitator in the agitator chamber.

14. The surface cleaning head of claim 13, wherein the rotatable driven agitator includes an end cap at the non-driven end, and wherein the engaging structure engages the end cap.

15. The surface cleaning head of claim 14, wherein the end cap includes an elastomeric pad, and wherein the engaging structure engages the elastomeric pad.

16. The surface cleaning head of claim 14, wherein the end cap is keyed to mate with the non-driven side of the agitator chamber with a particular orientation.

17. The surface cleaning head of claim 1, wherein the agitator chamber includes mounting rails at the non-driven side and the rotatable driven agitator includes an end cap at the non-driven end, and wherein the end cap fits between the mounting rails when mounted within the agitator chamber, and wherein the end cap is configured to slide between the mounting rails when inserting and removing the rotatable driven agitator.

18. The surface cleaning head of claim 17, wherein the end cap includes stabilizing structures engaging corresponding structures on the mounting rails.

19. The surface cleaning head of claim 18, wherein the stabilizing structures have a configuration keyed to mate with the mounting rails with a particular orientation.

20. The surface cleaning head of claim 1 wherein the external cover is movable between the closed position and the open position while remaining movably mounted to the cleaning head housing.

21. The surface cleaning head of claim 4, wherein the wedge-shaped spline teeth of the splined drive member are separated by spaces configured to receive the wedge-shaped spline teeth on the splined driven member, wherein each of the spaces have a radially outer portion that is wider than a radially inner portion.

22. The surface cleaning head of claim 1 wherein the agitator chamber includes a back side and a dirty air inlet formed in the back side.

23. A surface cleaning head for a vacuum, the surface cleaning head comprising:

a cleaning head housing having a front end portion, a rear end portion, laterally disposed sides, an upper portion and a bottom portion, wherein the upper portion extends over the bottom portion of the cleaning head housing;

an agitator chamber located in the front end portion of the cleaning head housing, the agitator chamber having a top opening through the upper portion of the cleaning head housing and a bottom opening through the bottom portion of the cleaning head housing, wherein the agitator chamber is configured to receive a rotatable driven agitator such that the agitator contacts a surface through the bottom opening and is removable through the top opening, and wherein the agitator chamber includes a non-driven side for receiving a non-driven end of the rotatable driven agitator and a driven side for receiving a driven end of the rotatable driven agitator;

an agitator drive mechanism including a drive member at a driven side of the agitator chamber and an agitator drive motor drivingly coupled to the drive member, wherein the drive member is configured to mate axially and engage with the driven member on the rotatable driven agitator such that the drive member transmits torque and rotation to the driven member and the rotatable driven agitator; and an external cover movably mounted to the cleaning head housing for covering the top opening of the agitator chamber at the front end portion of the cleaning head housing, the external cover being movable between a closed position and an open position by pivoting about a hinge pivotally coupling the external cover to a front bottom edge of the cleaning head housing and in a direction away from the rear end portion of the cleaning head housing, wherein the top opening of the agitator chamber is covered when the external cover is in the closed position and accessible through the top opening when the external cover is in the open position, and wherein at least part of the upper portion remains over the bottom portion when the external cover is in the open position.

24. The surface cleaning head of claim 23 wherein the drive member includes a splined drive member.

25. The surface cleaning head of claim 24 wherein the splined drive member includes wedge-shaped spline teeth.

26. The surface cleaning head of claim 25 wherein the wedge-shaped spline teeth have tapered sides.

27. The surface cleaning head of claim 24 wherein the splined drive member includes six spline teeth arranged in a star configuration around the axis of rotation.

28. The surface cleaning head of claim 23 wherein the drive motor is drivingly coupled to the drive member with a belt.

29. The surface cleaning head of claim 23 further comprising at least one transparent region in the external cover, the transparent region being configured to allow visual inspection of the agitator chamber when the external cover is in the closed position.

30. The surface cleaning head of claim 23 wherein the external cover includes an engaging structure protruding from an inside portion of the external cover for engaging the non-driven end of the rotatable driven agitator in the closed position to hold the agitator in the agitator chamber.

31. The surface cleaning head of claim 23 further comprising an agitator engaging member movably mounted to the cleaning head housing for movement into engagement with the non-driven end of the rotatable driven agitator to hold the agitator in the agitator chamber.

32. The surface cleaning head of claim 23, wherein the drive member includes wedge-shaped spline teeth having chamfered axial faces tapering inwardly toward the axis of rotation.

33. The surface cleaning head of claim 23, wherein the agitator chamber includes mounting rails at the non-driven side and wherein the mounting rails are configured to receive an end cap at the non-driven end of the rotatable driven agitator when mounted in the agitator chamber.

34. The surface cleaning head of claim 23 wherein the external cover is movable between the closed position and the open position while remaining movably mounted to the cleaning head housing.

35. The surface cleaning head of claim 25, wherein the wedge-shaped spline teeth of the splined drive member are separated by spaces configured to receive the wedge-shaped spline teeth on the splined driven member, wherein each of the spaces have a radially outer portion that is wider than a radially inner portion.

36. The surface cleaning head of claim 23 wherein the agitator chamber includes a back side and a dirty air inlet formed in the back side.

* * * * *